US008418871B1

(12) United States Patent
LaMasney

(10) Patent No.: US 8,418,871 B1
(45) Date of Patent: Apr. 16, 2013

(54) HYBRID PULP AND THERMOFORMED CONTAINERS

(75) Inventor: Robert G. LaMasney, Cross Plains, WI (US)

(73) Assignee: Plastic Ingenuity, Inc., Cross Plains, WI (US)

( * ) Notice: Subject to any disclaimer, the term of this patent is extended or adjusted under 35 U.S.C. 154(b) by 0 days.

(21) Appl. No.: 13/551,377

(22) Filed: Jul. 17, 2012

(51) Int. Cl.
*B65D 45/18* (2006.01)
*B65D 43/04* (2006.01)
*B65D 1/42* (2006.01)

(52) U.S. Cl.
USPC ..... 220/324; 220/657; 220/802; 53/486

(58) Field of Classification Search ..... 220/254.3, 220/254.1, 324, 315, 802, 801, 797, 796, 220/805, 212, 836, 810, 657, 656, 495.11, 220/495.08, 495.06, 309.1, 794, 659, 200; 215/327, 324; 53/486, 485, 484; *B65D 1/42, B65D 45/00, 45/18, 45/16, 43/04*
See application file for complete search history.

(56) References Cited

U.S. PATENT DOCUMENTS

| | | | | |
|---|---|---|---|---|
| 4,747,511 | A * | 5/1988 | Dutt et al. | 220/254.2 |
| 6,761,279 | B1 * | 7/2004 | Martin et al. | 220/258.2 |
| 2007/0045315 | A1 * | 3/2007 | Evans et al. | 220/254.3 |
| 2011/0108553 | A1 * | 5/2011 | Pantelleria | 220/319 |

OTHER PUBLICATIONS

Printout made Jul. 25, 2012 of the home page of the International Molded Fiber Association ("IMFA", www.imfa.org).
A printout made Jul. 25, 2012 from the International Molded Fiber Association ("IMFA", www.imfa.org) web site, relating to the four basic types of molded fiber (pulp) products.
2010 catalog from Sabert Corporation, obtained from their web (www.sabert.com) on Jul. 25, 2012.

* cited by examiner

*Primary Examiner* — Mickey Yu
*Assistant Examiner* — Robert J Hicks
(74) *Attorney, Agent, or Firm* — Rick L. Abegglen

(57) ABSTRACT

A hybrid thermoformed/pulp container comprising a pulp tray with a rim that includes an ear; and a thermoformed frame with a rib that includes a protrusion, wherein the pulp tray can be attached to the thermoformed frame by snapping the ear into position above the protrusion. Alternative embodiments of the invention include a kit for building the hybrid container, and a method of assembling the hybrid container.

19 Claims, 35 Drawing Sheets

HYBRID PULP AND THERMOFORMED CONTAINERS

FIELD OF THE INVENTION

This invention relates generally to the field of containers. More particularly, the present invention relates to hybrid containers made with a combination of pulp-type materials and thermoformed plastic.

BACKGROUND OF THE INVENTION

Consumers increasingly prefer products which reflect their own values. Products made or packaged using materials that are recyclable and/or renewable, for example, may be perceived as being environmentally friendly. A coffee cup that is made from a recyclable material may demonstrate a cultural value that reinforces customer loyalty. For all of those reasons, and many more, use of recyclable or renewable materials will continue to grow.

One important recyclable and renewable material is paper pulp which is renewable, recyclable, and can even be compostable. Pulp can be formed into many different shapes, from the humble egg carton to containers with a smooth finish closely resembling plastic. However, unlike more resilient materials like thermoformed plastic, paper pulp tends to lose its rigidity and structural integrity very quickly when subjected to mechanical deformation as may occur during ordinary handling.

Thermoformed plastic containers are well known as inexpensive and highly customizable containers for the sale of a wide variety of products, everything from cell phones to deli meats. Thermoformed plastic containers are typically made from petroleum that may often be recyclable, but is generally not renewable or compostable.

Simple hybrid containers that combine thermoformed plastic components with pulp components are also known. For example, plastic lids are commonly used along with pulp cups for coffee. Injection molded hybrid containers, which require assembly in an injection molder are also known. This type of container combines injection molded plastic formed around a molded fiber/paper part to form a permanently bonded part.

What is needed is a hybrid container that can combine both pulp and thermoformed plastic components to maximize renewable and/or recyclable content while maintaining the structural and functional advantages of thermoformed plastic.

SUMMARY OF THE INVENTION

A first embodiment of the invention is a hybrid thermoformed/pulp container comprising a pulp tray with a rim that includes an ear; and a thermoformed frame with a rib having inside and outside walls, with the outside wall including a protrusion, wherein the pulp tray can be attached to the thermoformed frame by snapping the ear into position above the protrusion in the interior of the rib.

A second embodiment of the invention is a hybrid thermoformed/pulp container kit comprising a pulp tray with a rim that includes an ear; and a thermoformed lid with a side wall that includes a protrusion, wherein the pulp tray can be attached to the thermoformed lid by snapping the ear into position above the protrusion.

A third embodiment of the invention is a method of forming a hybrid container comprising the steps of (A) providing a pulp tray with a rim that includes an ear; (B) providing a thermoformed lid with a side wall that includes a protrusion; (C) engaging the rim of the pulp tray with the side wall of the thermoformed lid; and (D) snapping the ear into position above the protrusion.

A hybrid container according to the invention can be shipped or stored with its components separately nested to conserve space. A retailer or end user can assemble it in the field, with no specialty machinery required. An end user or recycling facility can separate pulp content from plastic content for separate recycling streams. A hybrid container according to the invention can also increase the proportion of recyclable or even compostable or biodegradable content.

Further objects, features, and advantages of the invention will be apparent from the following detailed description when taken in conjunction with the accompanying drawings.

DETAILED DESCRIPTION OF THE INVENTION

Figure 1A:
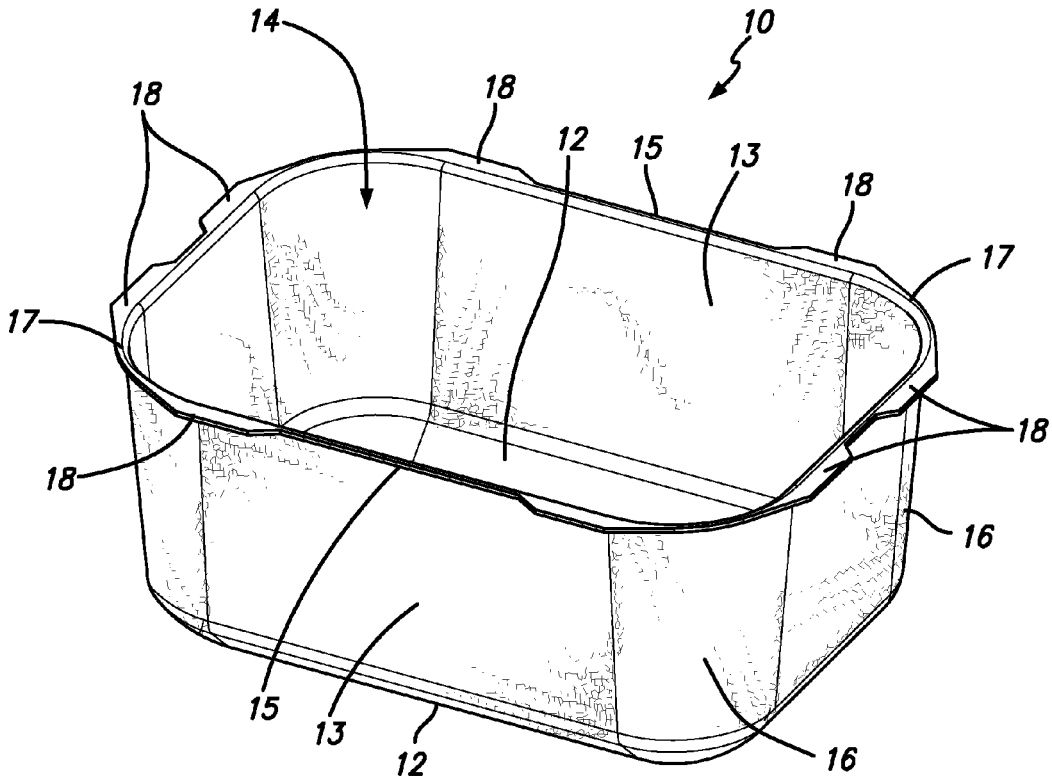
FIGS. 1A, 1B, 1C, and 1D are perspective, top, first side, and second side views, respectively, of a pulp tray for a container according to the invention.
Figure 1B:
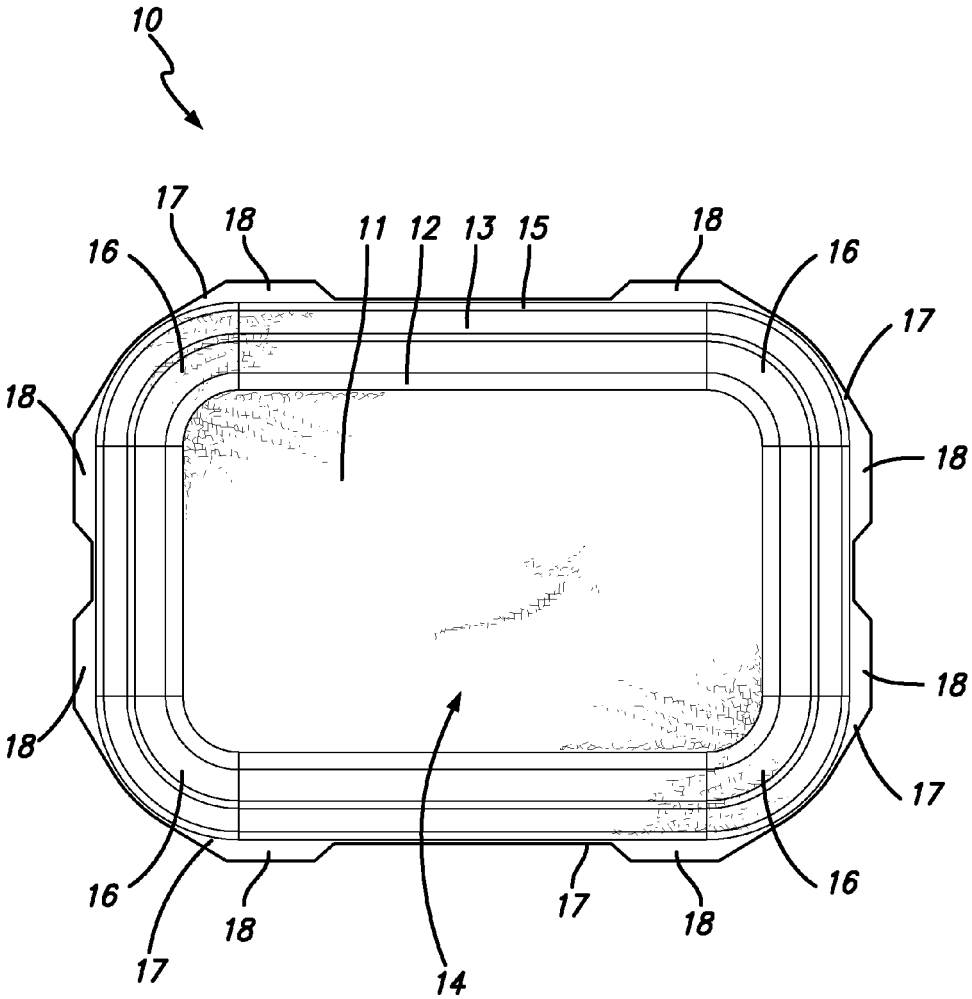
Figure 1C:
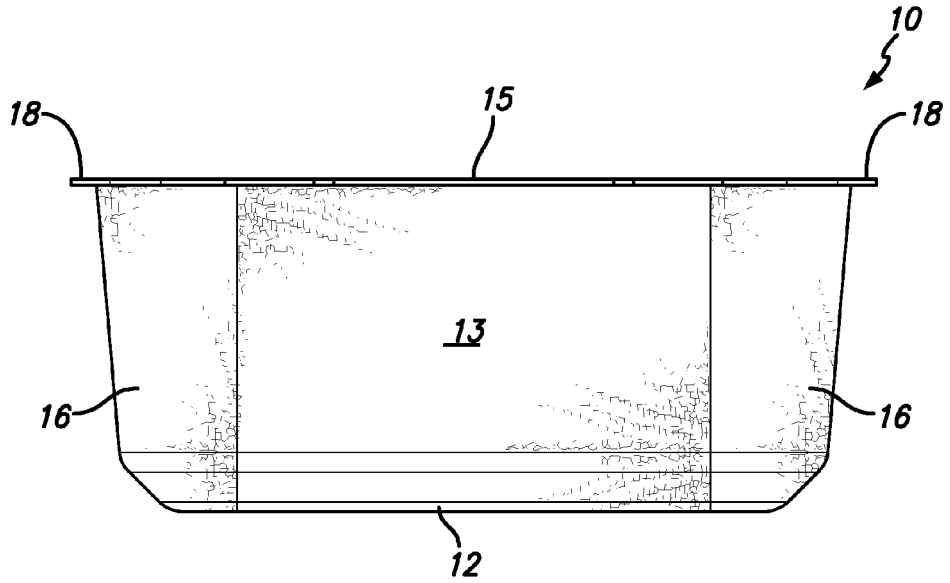
Figure 1D:
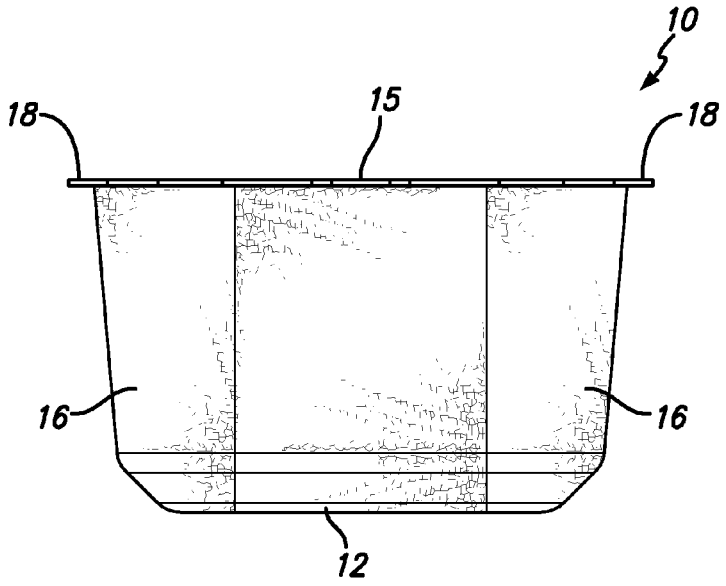

FIGS. 1A, 1B, 1C, and 1D are perspective, top, first side, and second side views, respectively, of a pulp tray 10 for a container according to the invention. As perhaps best shown in FIG. 1B, the pulp tray 10 includes a cavity floor 11 surrounded by cavity floor side wall corners 12. Cavity side walls 13 extend upward from the cavity floor side wall corners 12, forming a cavity 14 with cavity corners 16.

The cavity side walls 13 terminate in a cavity rim 15 around the cavity 14, and may include cavity corners 16. The cavity rim 15 includes a pulp tray peripheral flange 17, which may include one or more pulp tray flange ears 18 formed as relatively wide portions of the peripheral flange 17. However this is not required, and the entire peripheral flange 17 may be of uniform width.

Figure 2A:
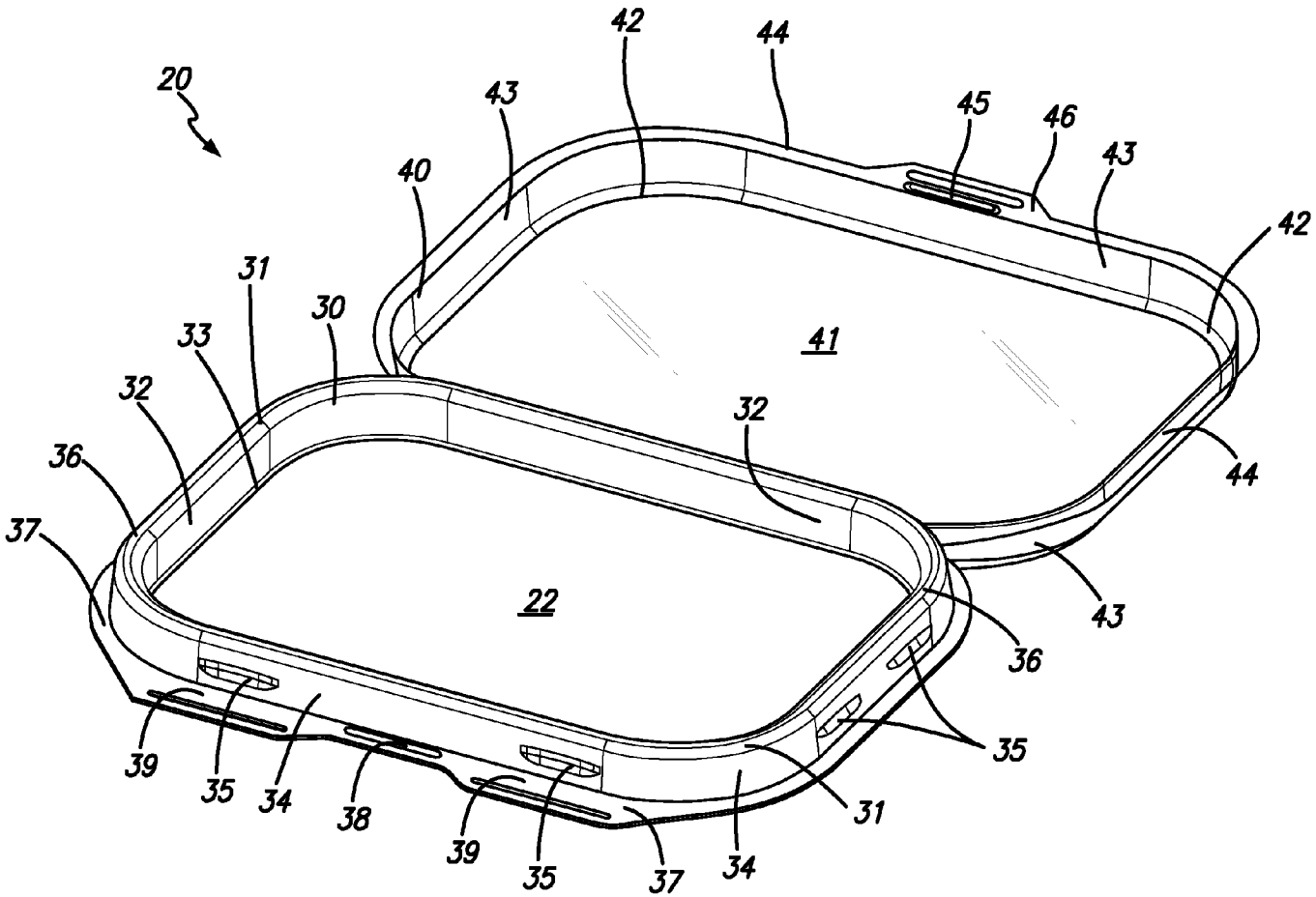
FIGS. 2A, 2B and 2C are perspective, top, and side views, respectively, of a thermoformed hinged lid for a container according to the invention.
Figure 2B:
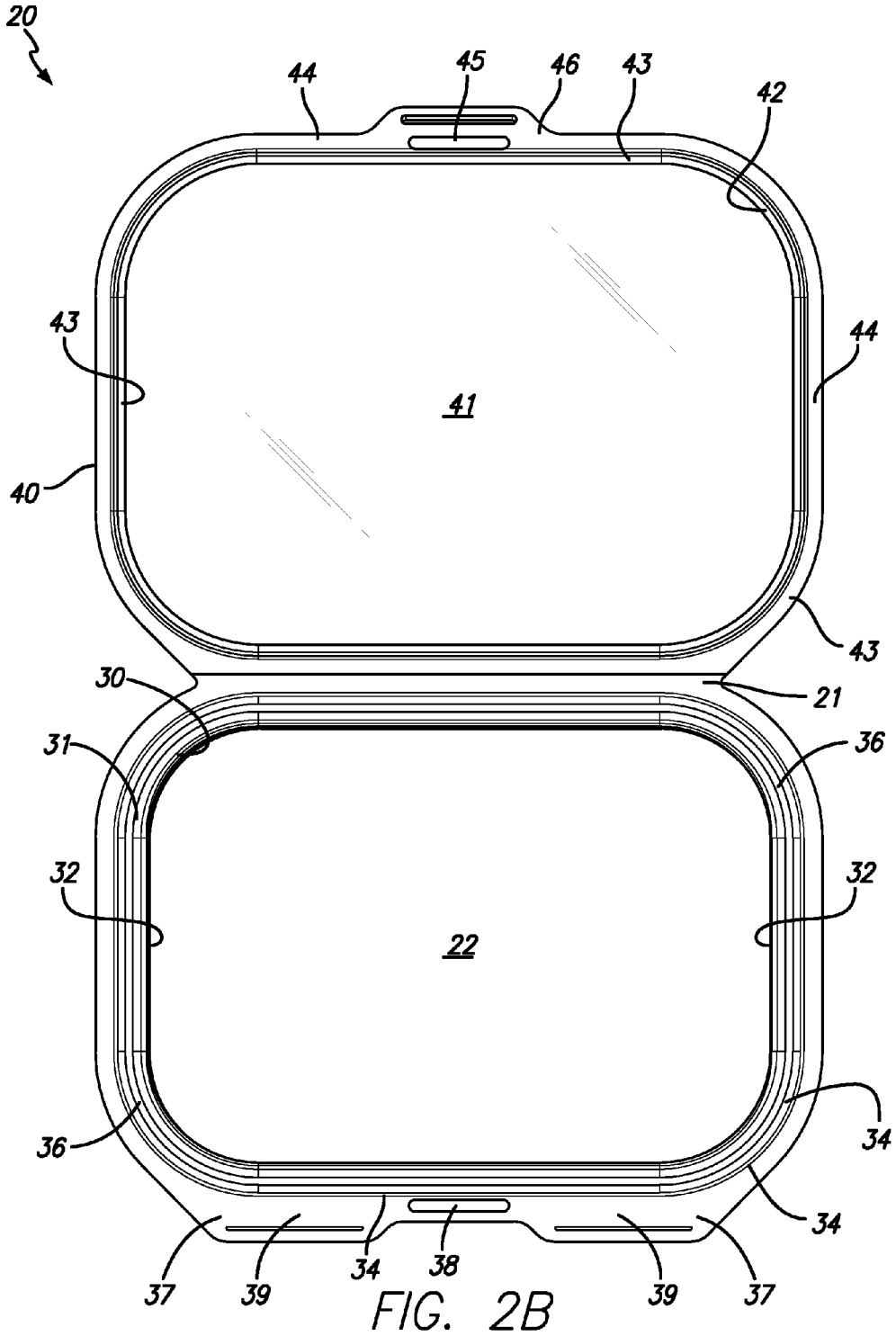
Figure 2C:
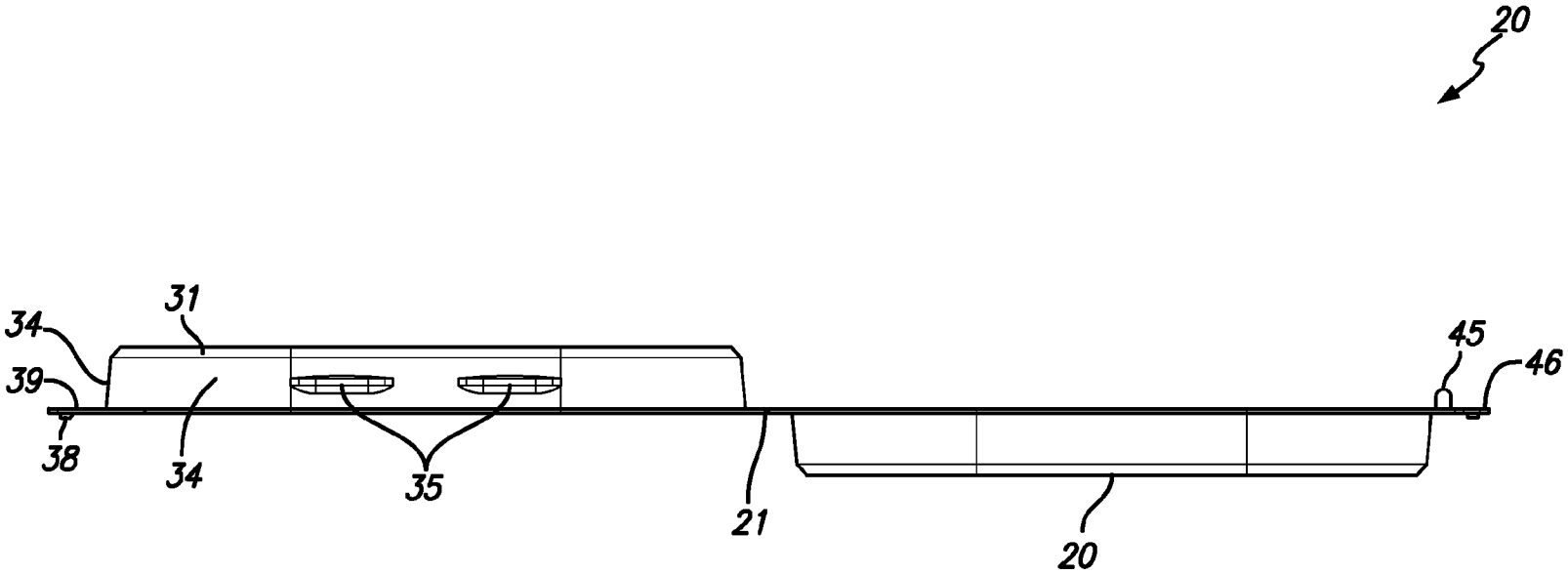

FIGS. 2A, 2B and 2C are perspective, top, and side views, respectively, of a thermoformed hinged lid 20 for a container according to the invention. As perhaps best shown in FIG. 2B, the thermoformed hinged lid 20 includes a hinged frame 30 with a hinge 21 that allows a hinged cover 40 to swing in and out of position on the frame 30, to cover or uncover a hinged frame opening 22.

The hinged frame 30 includes a convex hinged frame rib 31 that surrounds the hinged frame opening 22. The rib 31 has hinged frame inside walls 32 terminating in hinged frame inside flanges 33 that surround the hinged frame opening. The hinged frame rib 31 has outside walls 34 that terminate in peripheral flanges 37, which may include one or more flange ears 39. The hinged frame inside walls 32 and hinged frame outside walls 34 meet at a hinged frame rib peak 36 that forms the upper surface of the rib 31.

The hinged cover 40 includes a hinged cover central portion 41 extending to hinged cover side wall corners 42. Hinged cover side walls 43 extend from the side wall corners 42 to a hinged cover peripheral flange 44, which may include one or more hinged cover flange ears 46.

The outside walls 34 of the hinged frame rib 31 include hinged frame outside wall exterior surface indents that form protrusions 35 extending into the rib interior region defined between the inside walls 32 and outside walls 34. As explained in more detail below with respect to the exemplary container 50, the protrusions 35 can engage with pulp tray flange ears 18 on a pulp tray 10. The peripheral flange 37 of the frame 30 may include a hinged frame flange slot 38 for engagement with a hinged cover flange ridge 45 on the cover 40. The slot 38 may be formed as a die cut hole, so that the slot 38 and ridge 45 together can form a friction latch to snap the cover 40 closed on the frame 30. However, other snap closures could be used, for example an indentation could be used instead of a die cut hole, multiple latches could be used, or the positions of the slot and ridge could be swapped.

For purposes of illustration and not as a limitation, the names of the various portions of the pulp tray 10 and thermoformed hinged lid 20 (e.g. top, side, bottom, rear, etc.) assume that these pieces are positioned in an upright standing position with the cavity side of the tray facing up and the hinged lid positioned to mate with the tray.

Figure 3A:
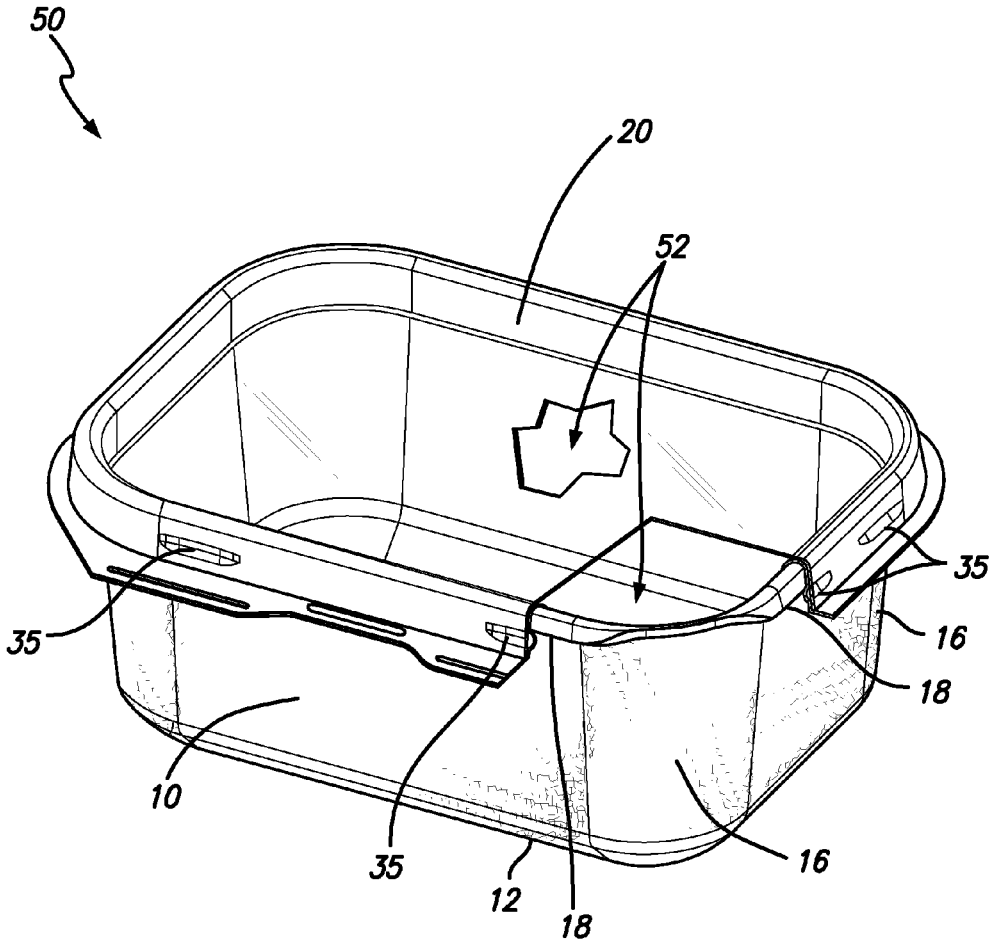
FIGS. 3A and 3B are perspective views of a hybrid container with a hinged lid according to the invention, with the lid in a closed position in FIG. 3A and with the hinged lid in an open position in FIG. 3B.
Figure 3B:
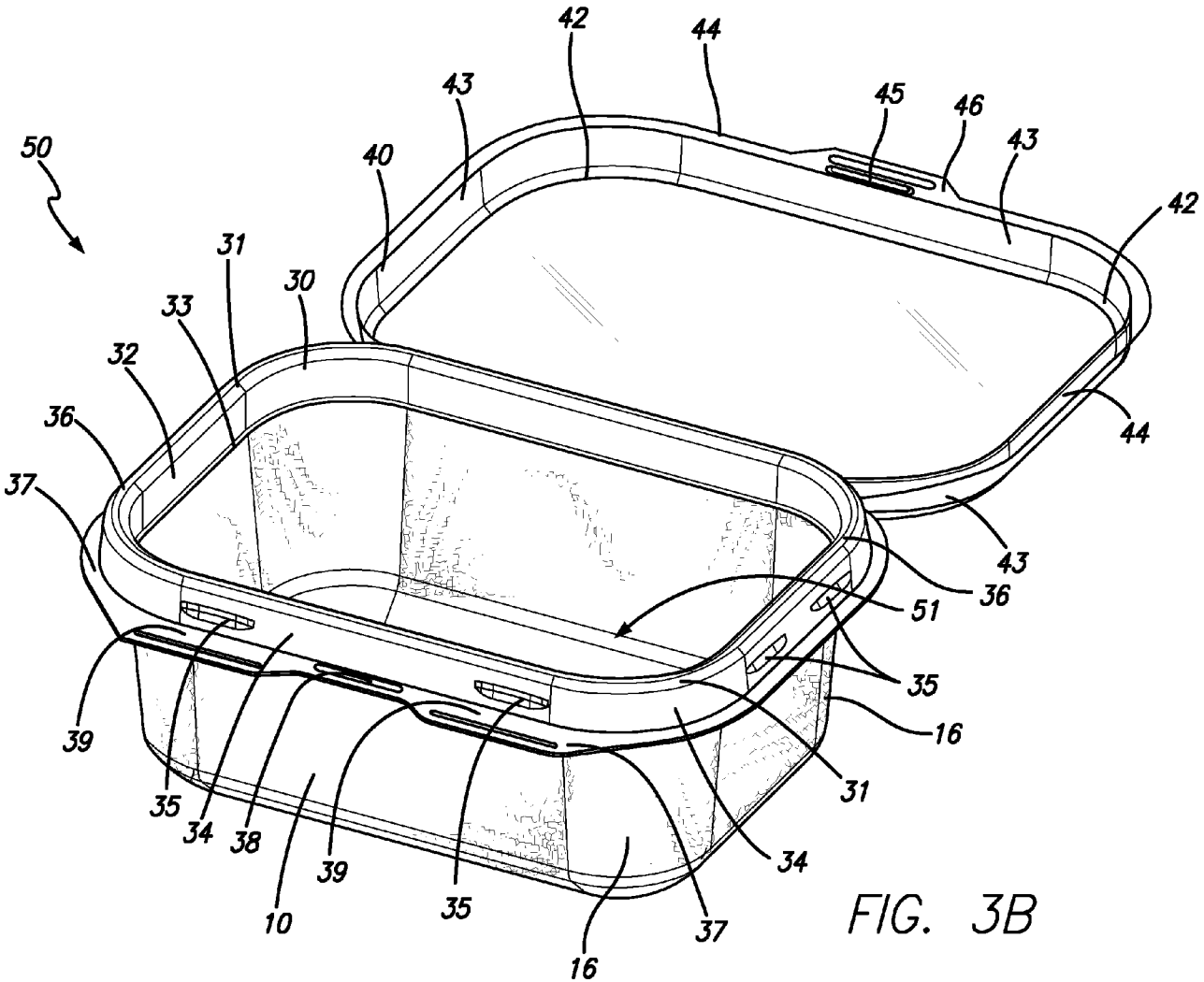
Figure 3C:
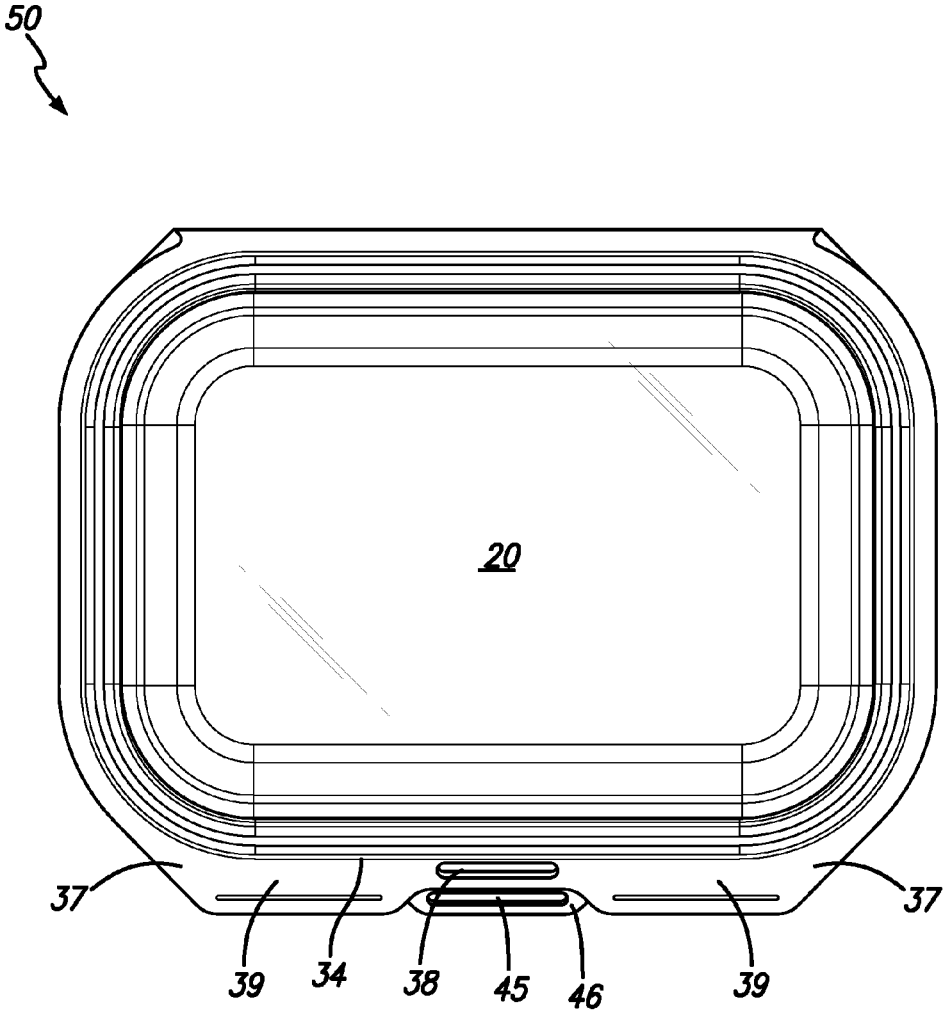
FIGS. 3C, 3D, and 3E are top, first side, and second side views, respectively, of the container of FIG. 3A.
Figure 3D:
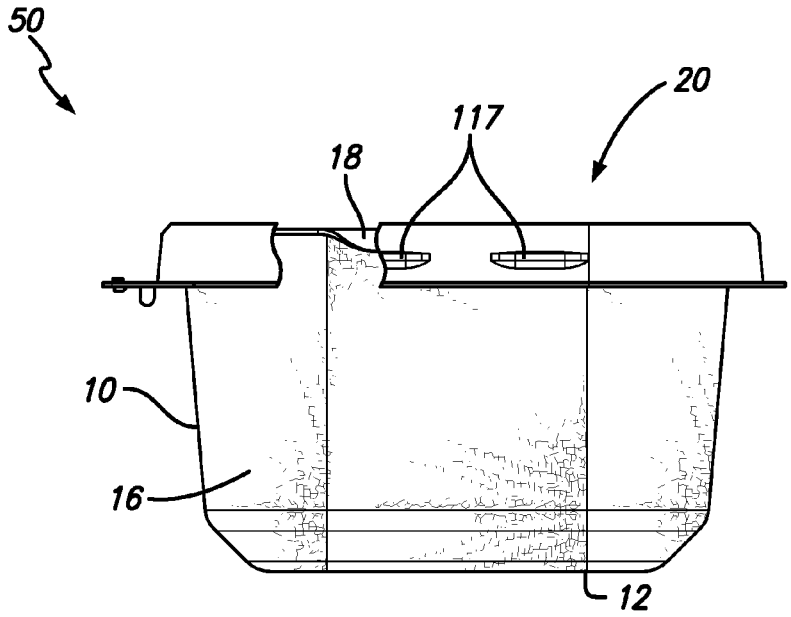
Figure 3E:
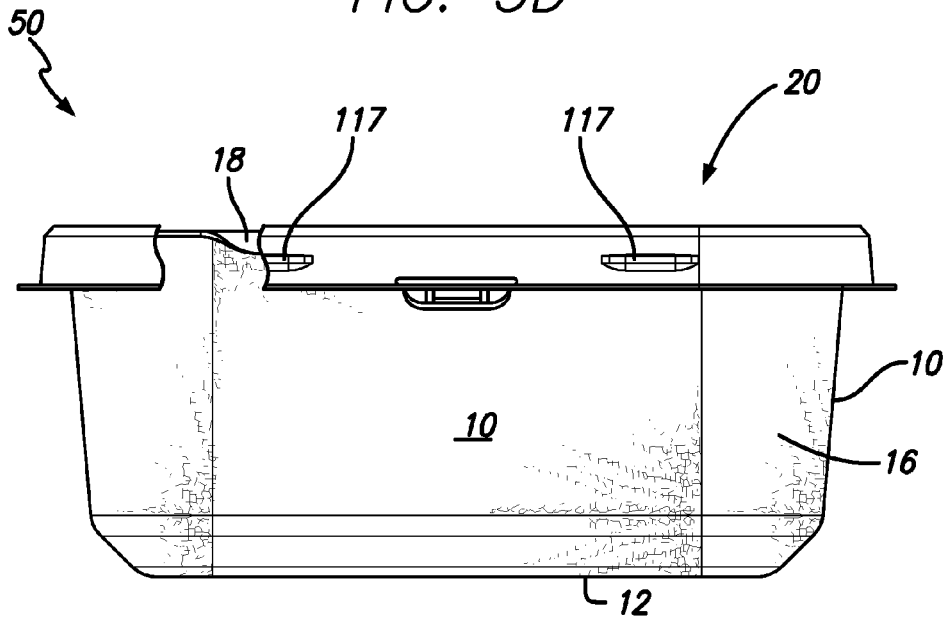
Figure 4A:
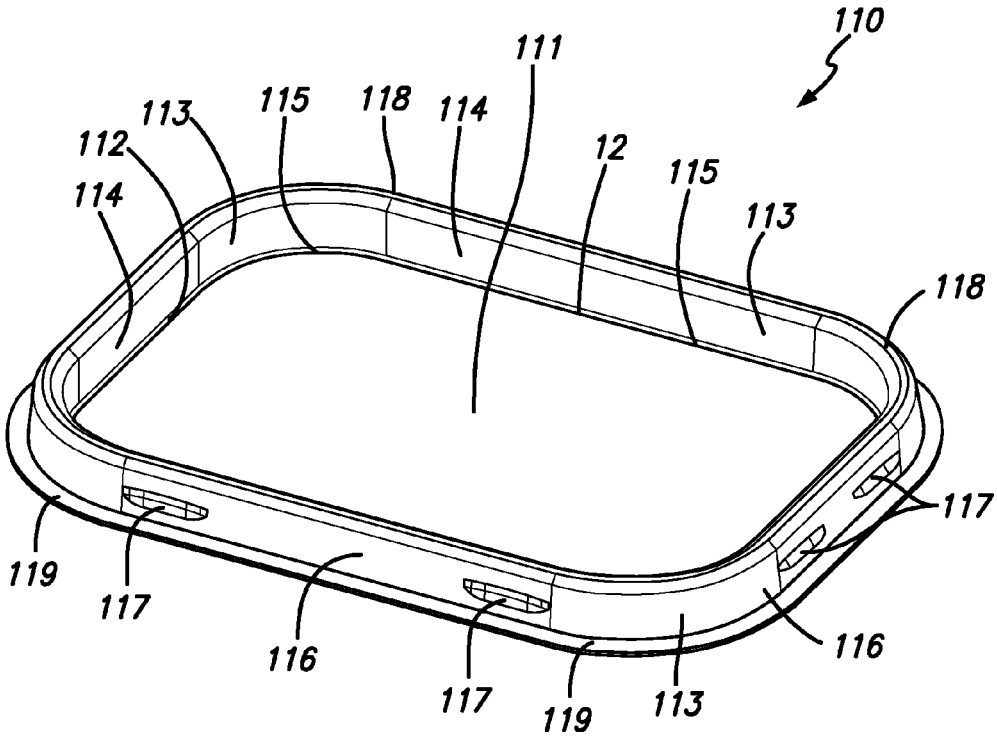
FIGS. 4A, 4B, 4C, and 4D are perspective, top, first side, and second side views, respectively, of a thermoformed collar for a container according to the invention.
Figure 4B:
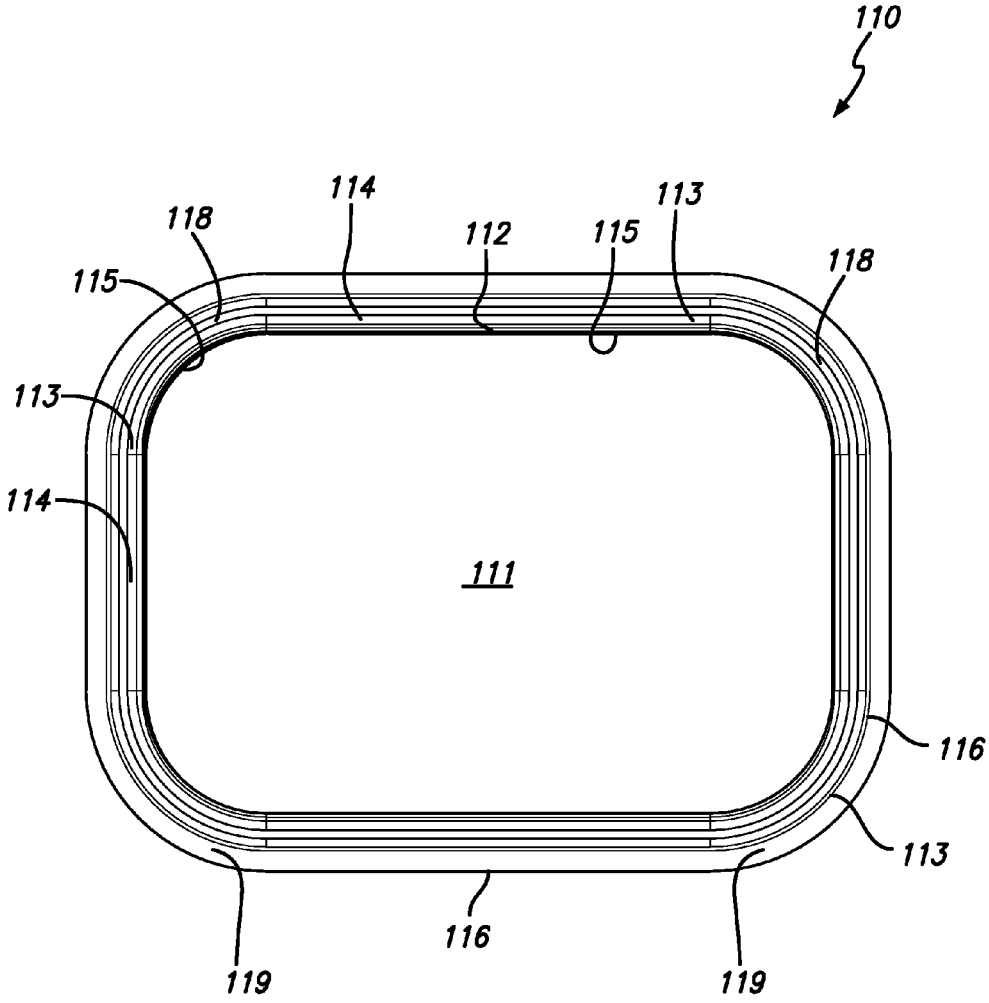
Figure 4C:
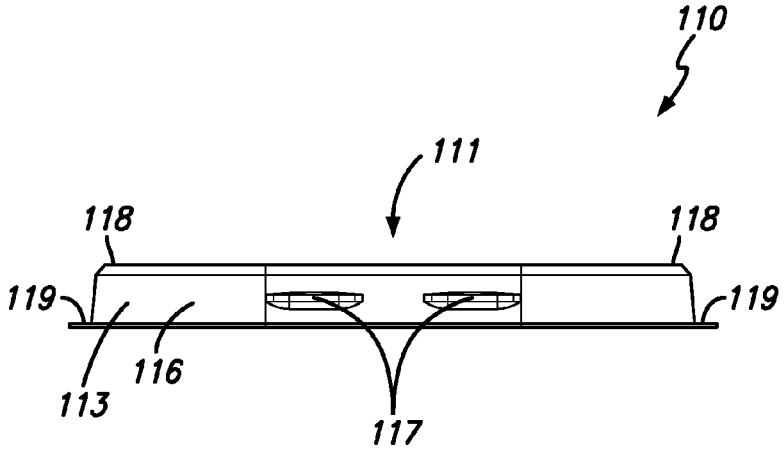
Figure 4D:
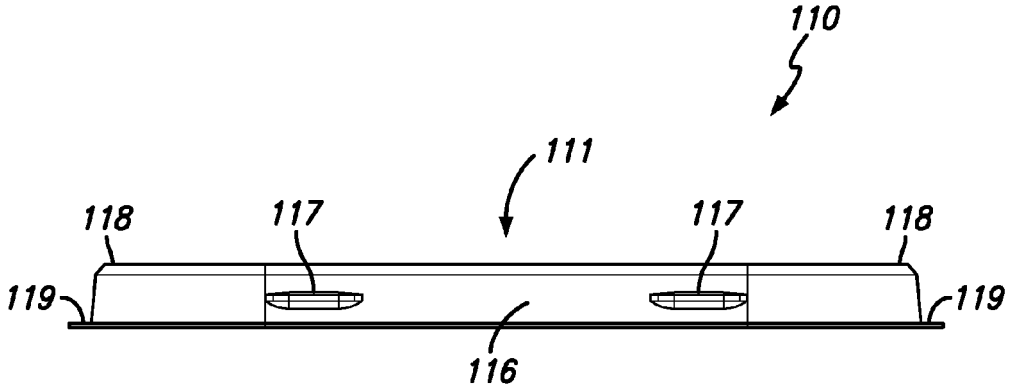
Figure 5A:
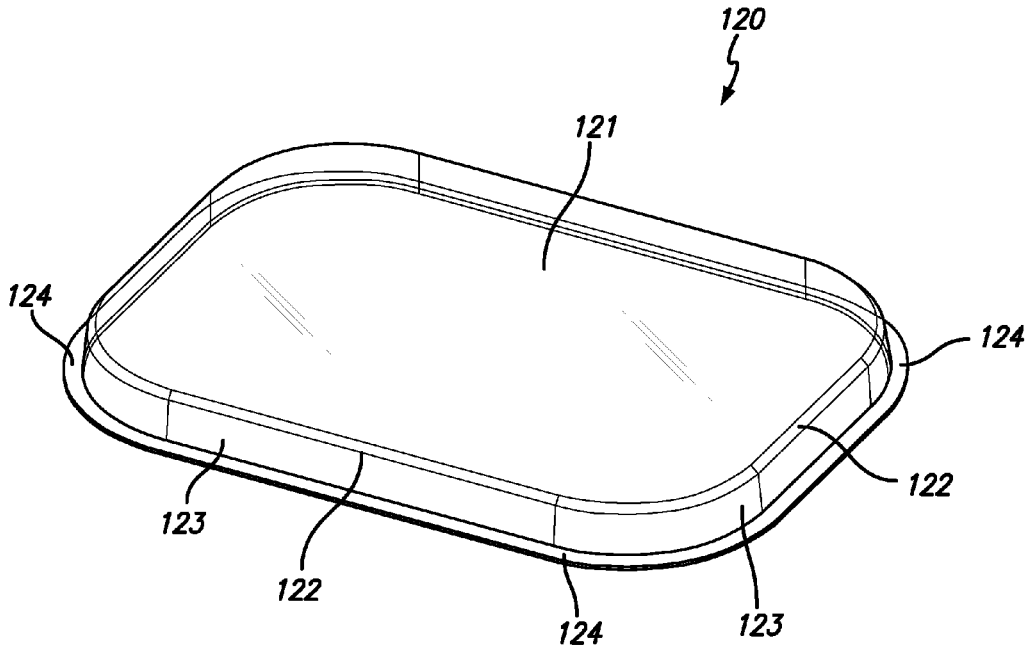
FIGS. 5A, 5B, 5C, and 5D are perspective, top, first side, and second side views, respectively, of a first thermoformed cover for a container according to the invention.
Figure 5B:
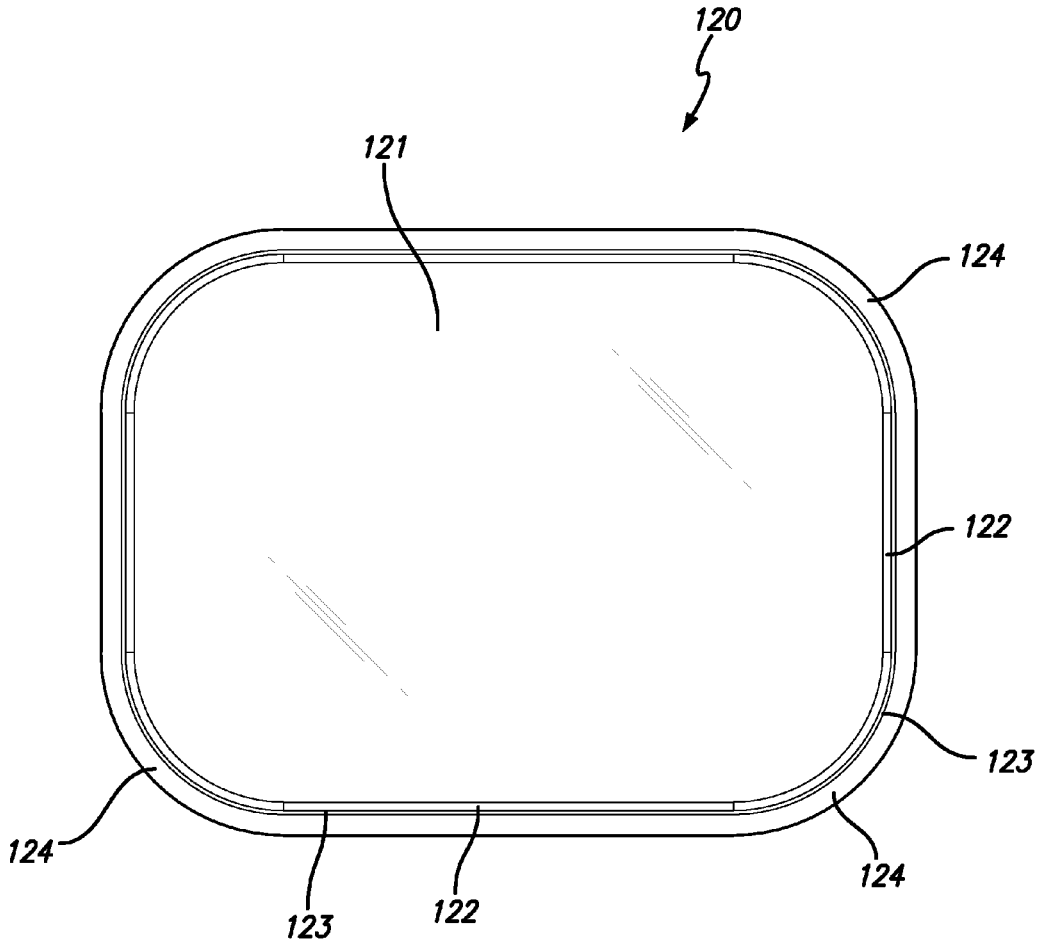
Figure 5C:
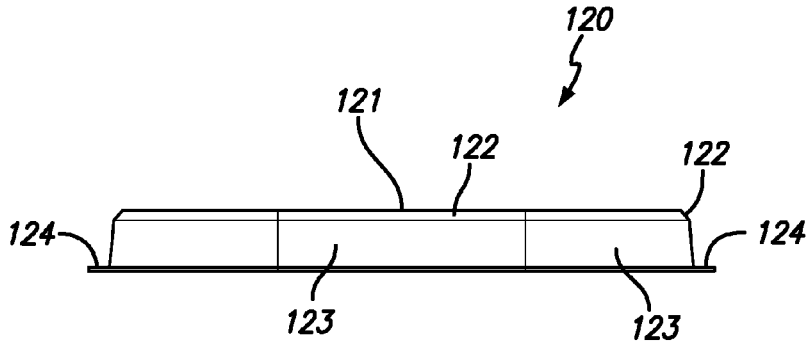
Figure 5D:
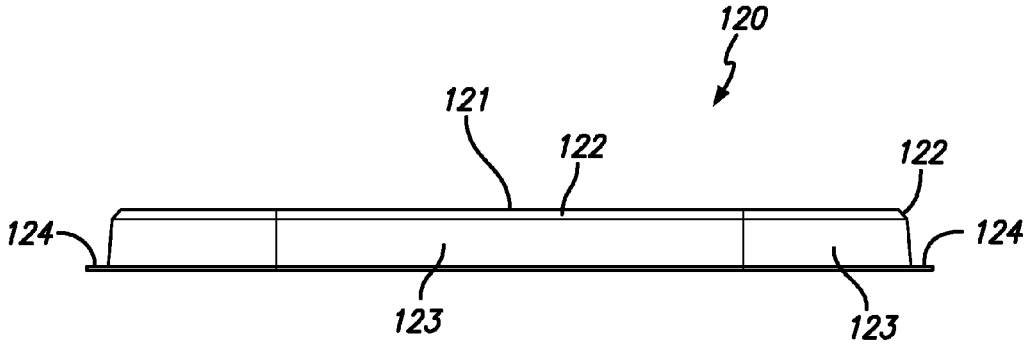

FIGS. 3A and 3B are perspective views of a hybrid container with a hinged lid 50, comprising the tray 10 of FIG. 1 and the thermoformed hinged lid 20 of FIG. 2. FIG. 3A shows the lid in a closed position, thereby forming a closed container with a first closed compartment 52. FIG. 3B shows the hinged lid in an open position, thereby forming an open container with a first open compartment 51. FIGS. 3C, 3D, and 3E are top, first side, and second side views, respectively, of the container of FIG. 3A.

As perhaps best shown in the cutaway view of FIG. 3A, the hybrid container with a hinged lid 50 is formed by snapping the thermoformed hinged lid 20 onto the pulp tray 10. This is accomplished by engaging the rim 15 of the pulp tray 10 with the rib 31 of the thermoformed frame 30, and pressing the pulp tray 10 into the frame 30 so that the ears 18 of the pulp tray 10 snap into position above the protrusions 35 on the thermoformed frame 30. Although the exemplary container 50 includes ears 18 formed as widened portions of the flange 17, this is not required. For example, the entire peripheral flange 17 may be of uniform width, without any ears, and any portion of that flange 17 can be snapped into position about the protrusions on the thermoformed frame.

FIGS. 4A, 4B, 4C, and 4D are perspective, top, first side, and second side views, respectively, of a thermoformed collar 110 for a container according to the invention. The thermoformed collar 110 includes a collar rib 113 that surrounds the collar opening 111 that has a collar opening periphery 112. The collar rib 113 has collar inside walls 114 terminating in collar inside flanges 115 surrounding the collar opening 111. The collar rib 113 has collar outside wall 116 that terminate in collar peripheral flanges 119, which may include one or more flange ears (not shown). The collar inside walls 114 and collar outside wall 116 meet at a collar rib peak 118 that forms the upper surface of the collar rib 113.

The collar outside walls 116 include one or more collar outside wall exterior surface indents that form corresponding bumps or protrusions 117 extending into the collar interior region defined between the inside walls 114 and outside walls 116. As explained in more detail below with respect to the exemplary container 150, the protrusions 117 can engage with a portion of the flange on a pulp tray 10.

FIGS. 5A, 5B, 5C, and 5D are perspective, top, first side, and second side views, respectively, of a first thermoformed cover 120 for a container according to the invention. The thermoformed cover 120 has a thermoformed cover central portion 121 extending to thermoformed cover side wall corners 122. Thermoformed cover side walls 123 extend from the thermoformed cover side wall corners 122 to a thermoformed cover peripheral flange 124.

Figure 6A:
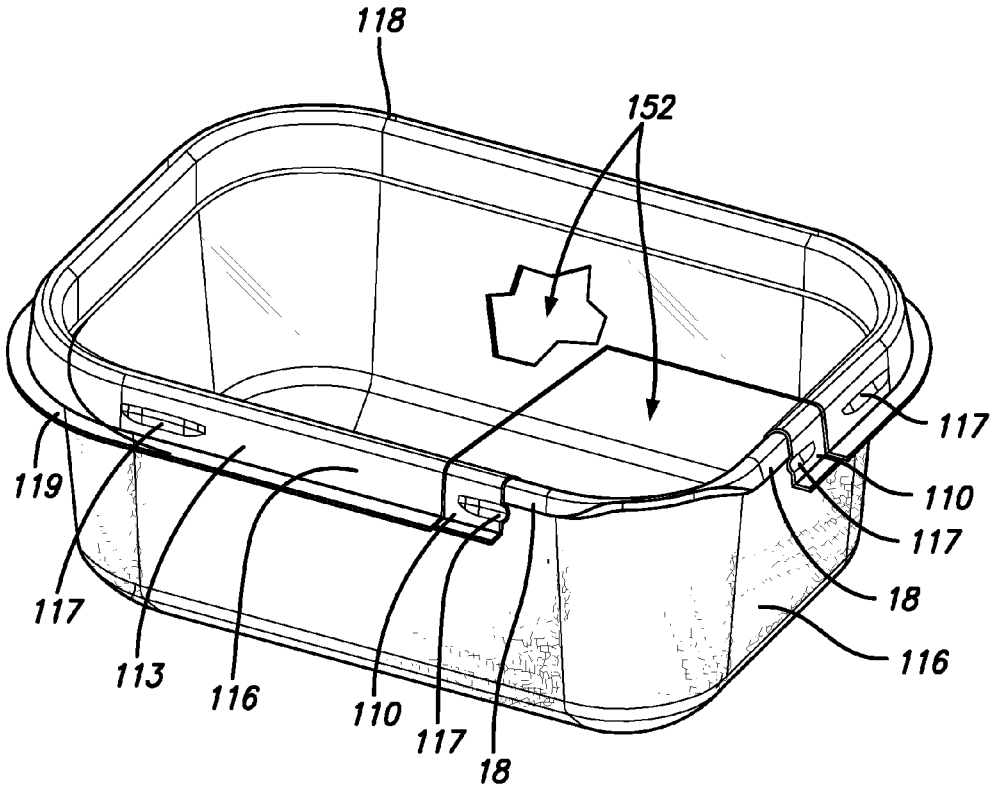
FIGS. 6A and 6B are perspective views of a hybrid container with a pulp tray, a thermoformed collar, and a separable thermoformed cover according to the invention, with the thermoformed cover positioned on the collar to form a closed container in FIG. 6A and with the thermoformed cover separated from the collar to expose the interior of the tray in FIG. 6B.
Figure 6B:
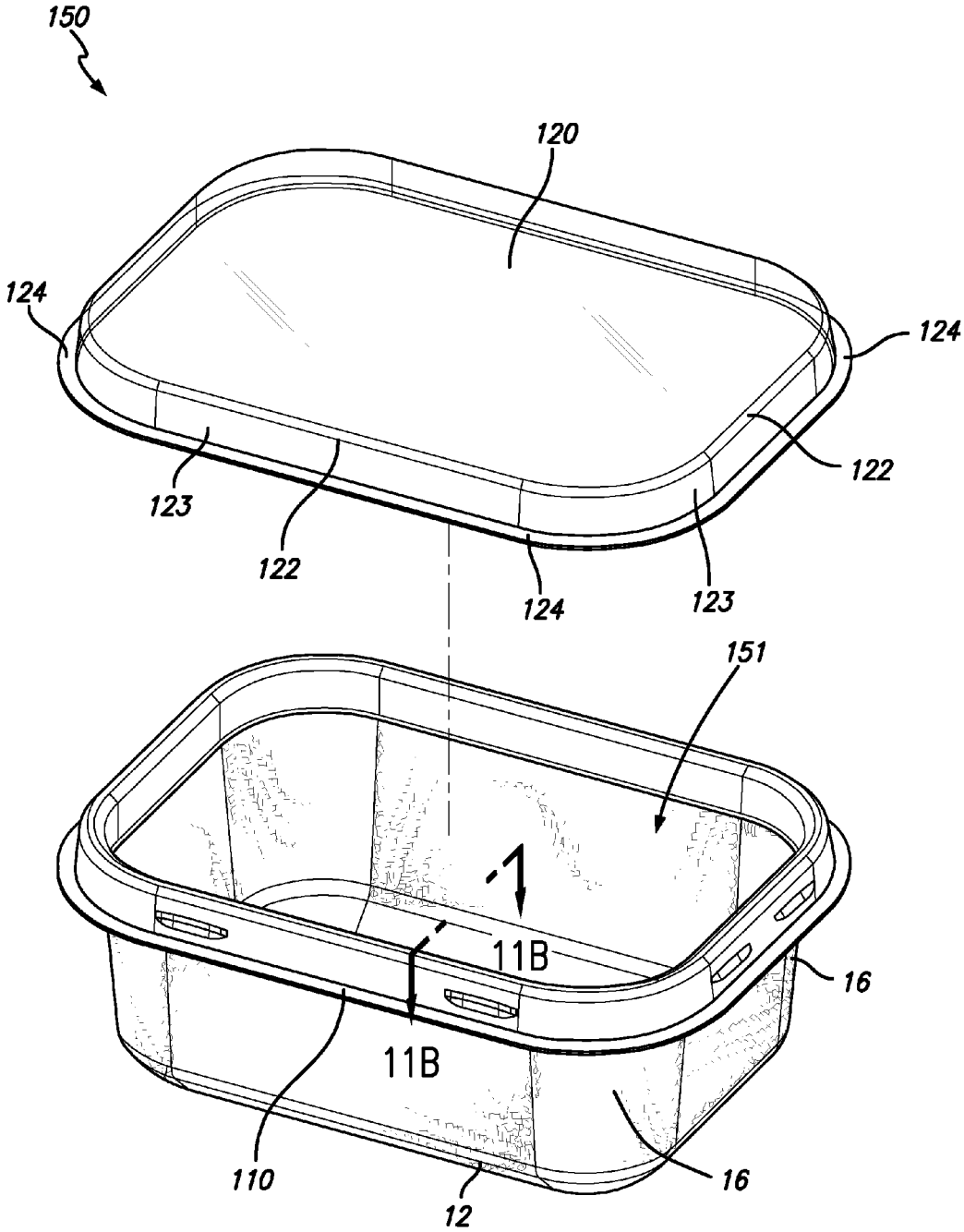
Figure 6C:
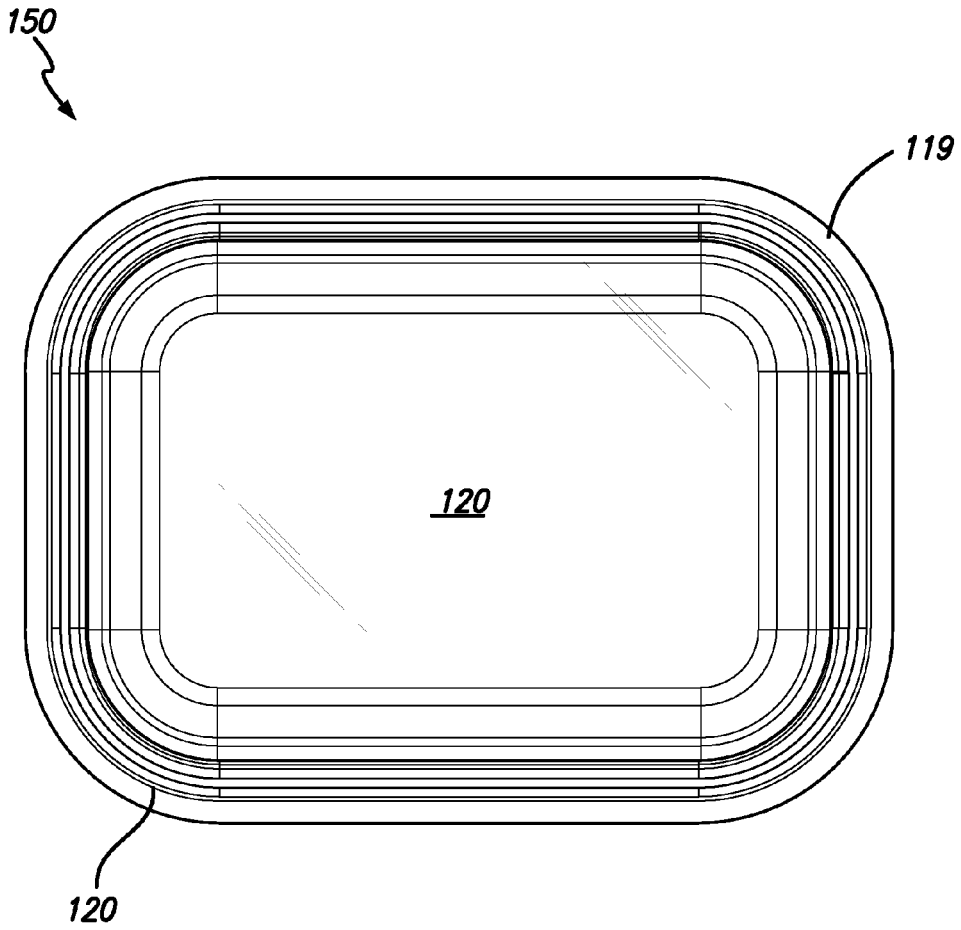
FIGS. 6C, 6D, and 6E are top, first side, and second side views, respectively, of the container of FIG. 6A.
Figure 6D:
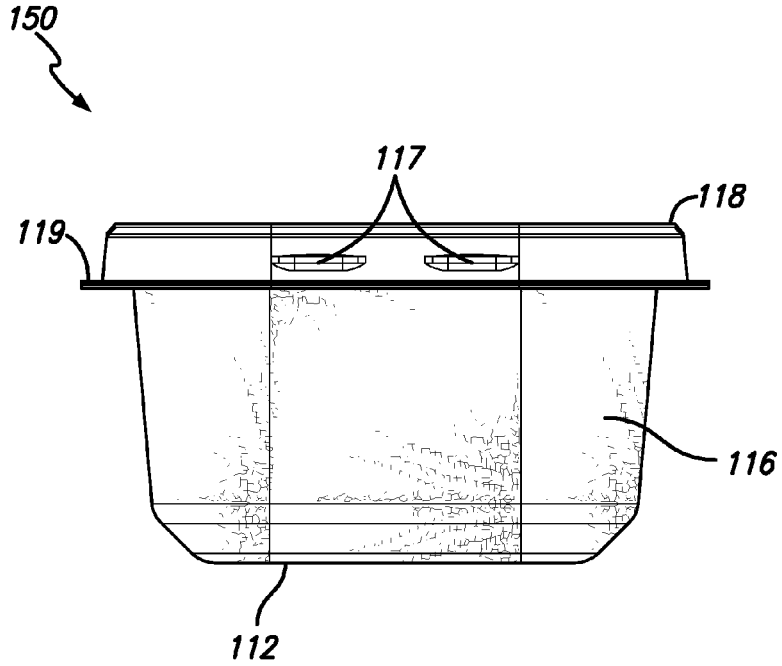
Figure 6E:
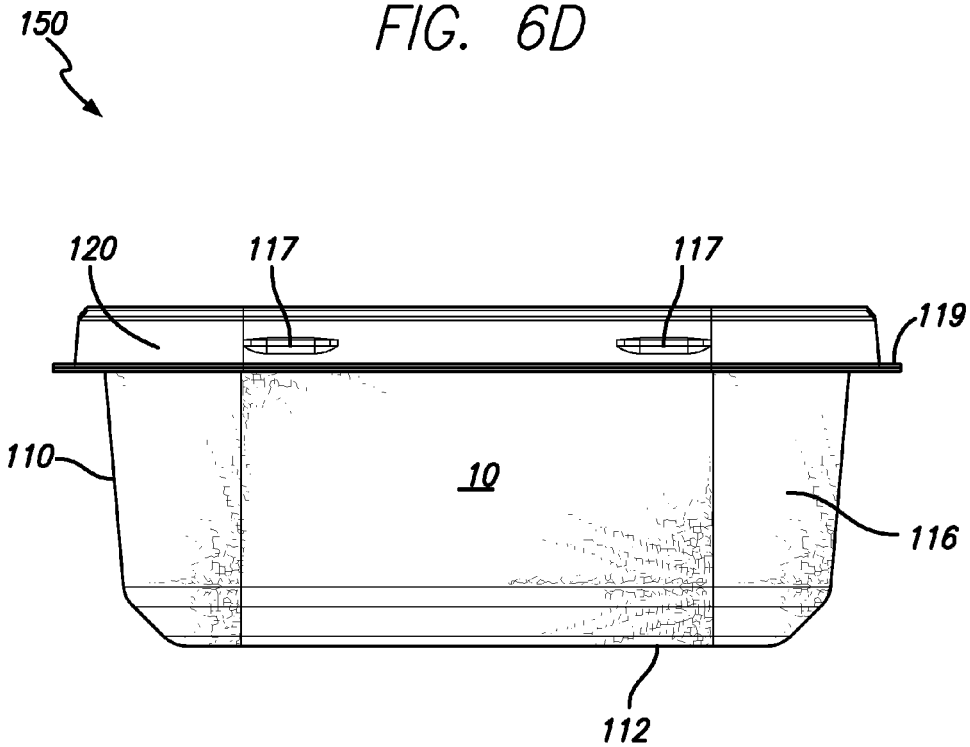
Figure 7A:
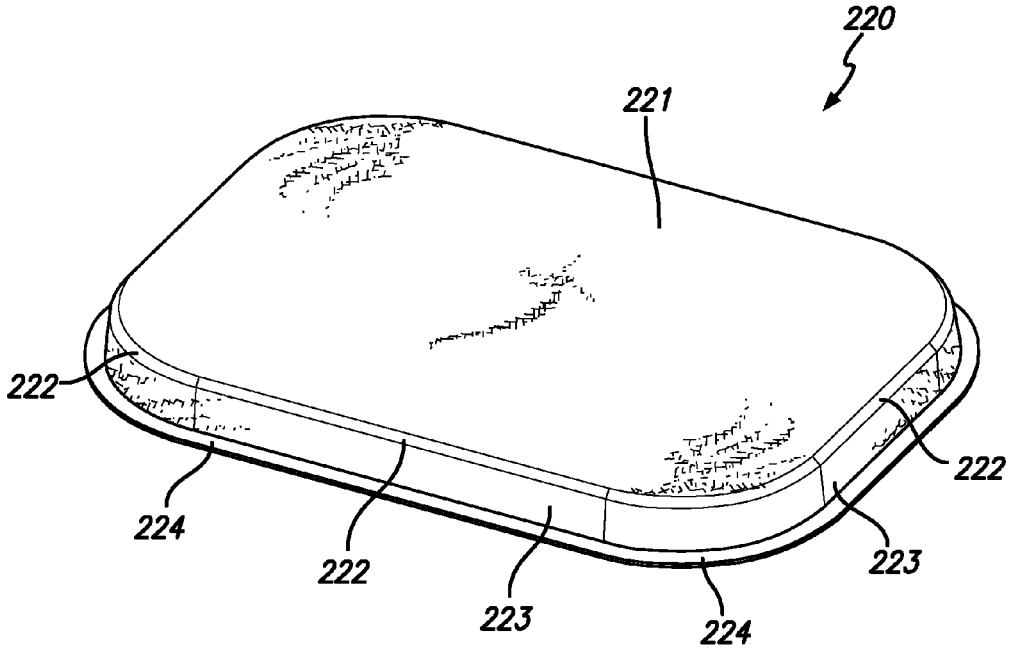
FIGS. 7A, 7B, 7C, and 7D are perspective, top, first side, and second side views, respectively, of a pulp cover for a container according to the invention.
Figure 7B:
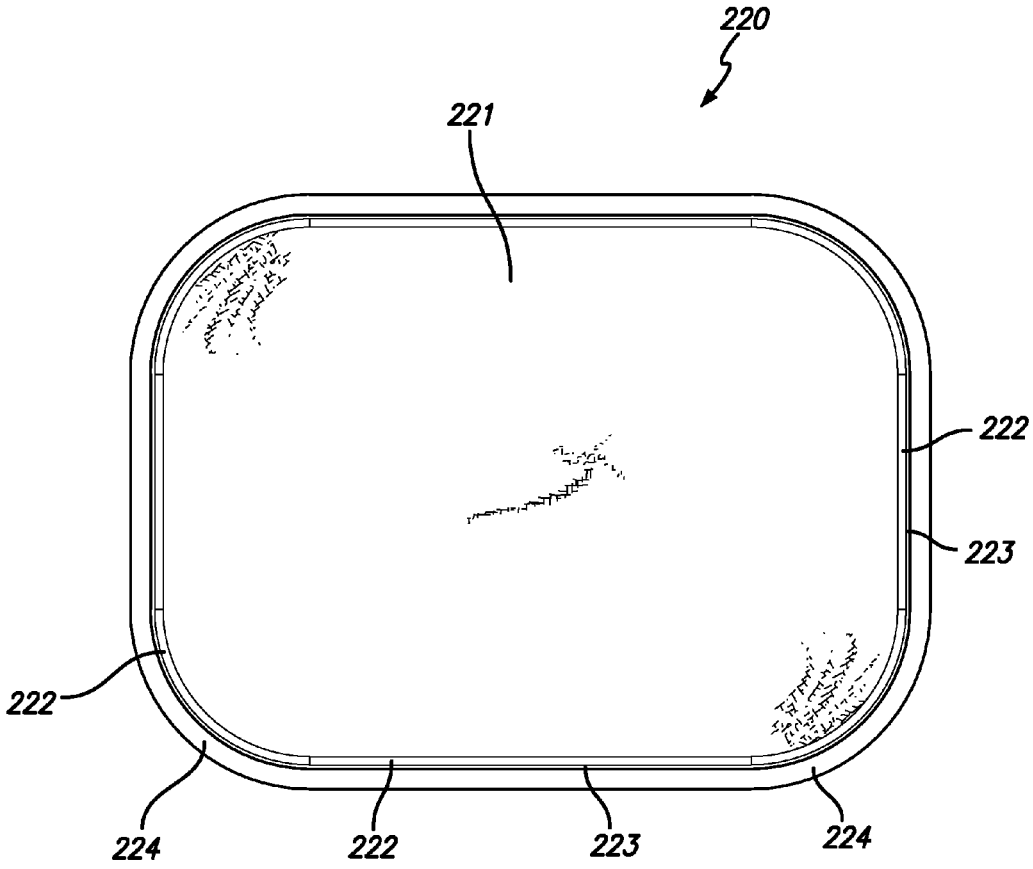
Figure 7C:
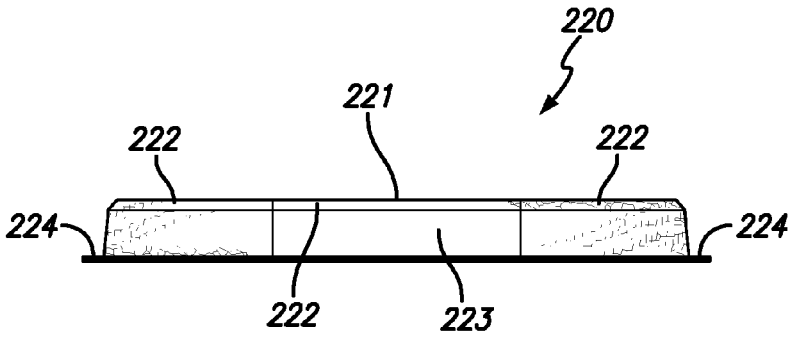
Figure 7D:
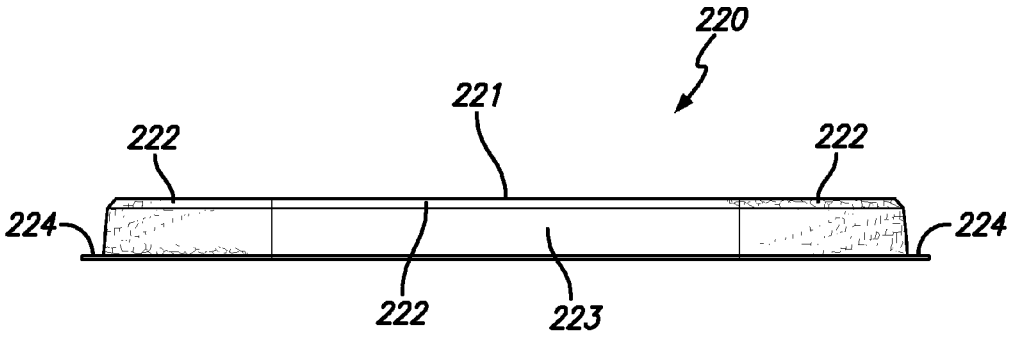

FIGS. 6A and 6B are perspective views of a second hybrid container 150 with a pulp tray 10, a thermoformed collar 110, and a separable thermoformed cover 120 according to the invention. FIG. 6A shows the thermoformed cover 120 positioned on the collar, thereby forming a second closed compartment 152. FIG. 6B shows the thermoformed cover separated from the collar to expose the interior of the tray and form a second open compartment 151. FIGS. 6C, 6D, and 6E are top, first side, and second side views, respectively, of the second hybrid container 150 of FIG. 6A.

As perhaps best shown in the cutaway view of FIG. 6A, the second hybrid container 150 is formed by snapping the thermoformed collar 110 onto the pulp tray 10. This is accomplished by engaging the rim 15 of the pulp tray 10 with the rib 113 of the thermoformed collar 110, and pressing the pulp tray 10 into the thermoformed collar 110 so that the ears 18 of the pulp tray 10 snap into position above the protrusions extending into the interior of the thermoformed collar 110.

Once the thermoformed collar 110 is in place on the pulp tray 10, the thermoformed cover 120 can be fitted onto the collar 110 with either a friction fit, or using an interference structure.

FIGS. 7A, 7B, 7C, and 7D are perspective, top, first side, and second side views, respectively, of a pulp cover 220 for a container according to the invention. The pulp cover 220 has a pulp cover central portion 221 extending to pulp cover side wall corners 222. Pulp cover side walls 223 extend from the pulp cover side wall corners 222 to pulp cover peripheral flanges 224.

Figure 8A:
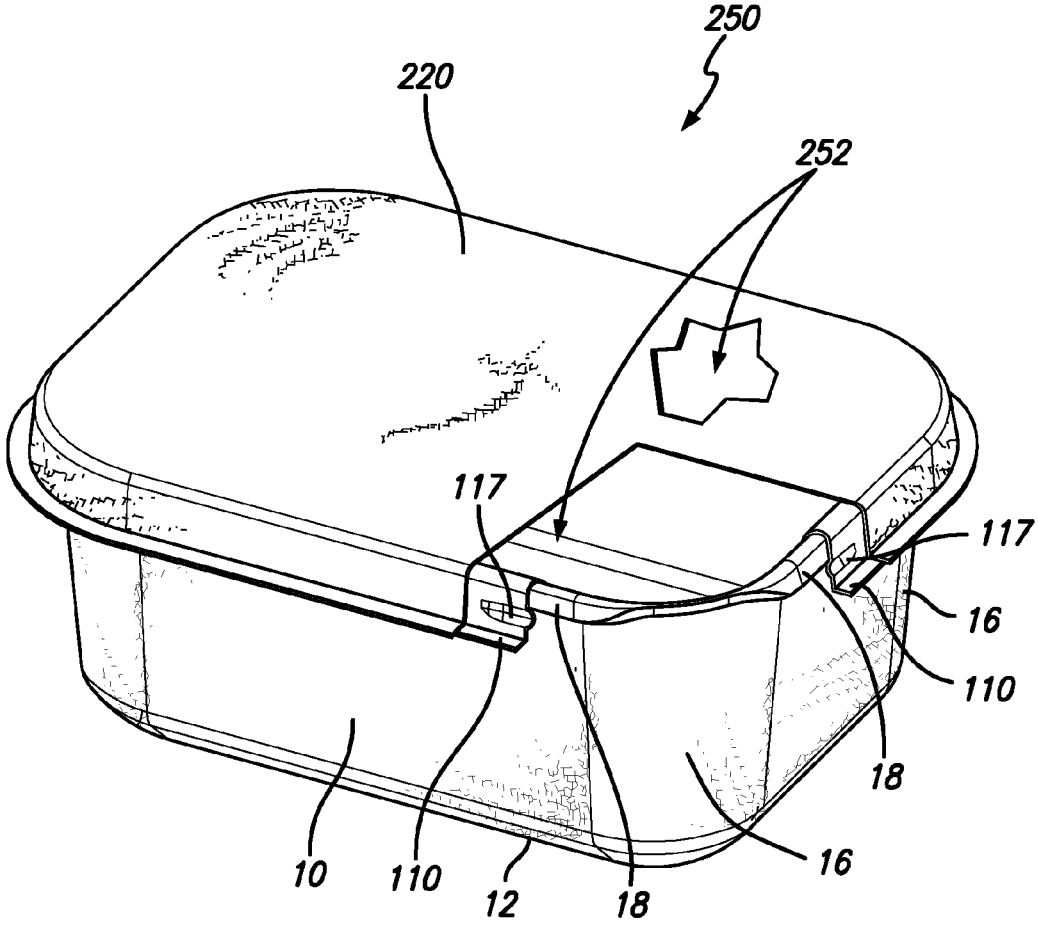
FIGS. 8A and 8B are perspective views of a hybrid container with a pulp tray, a thermoformed collar, and a separable pulp cover according to the invention, with the pulp cover positioned on the collar to form a closed container in FIG. 8A and with the pulp cover separated from the collar to expose the interior of the tray in FIG. 8B.
Figure 8B:
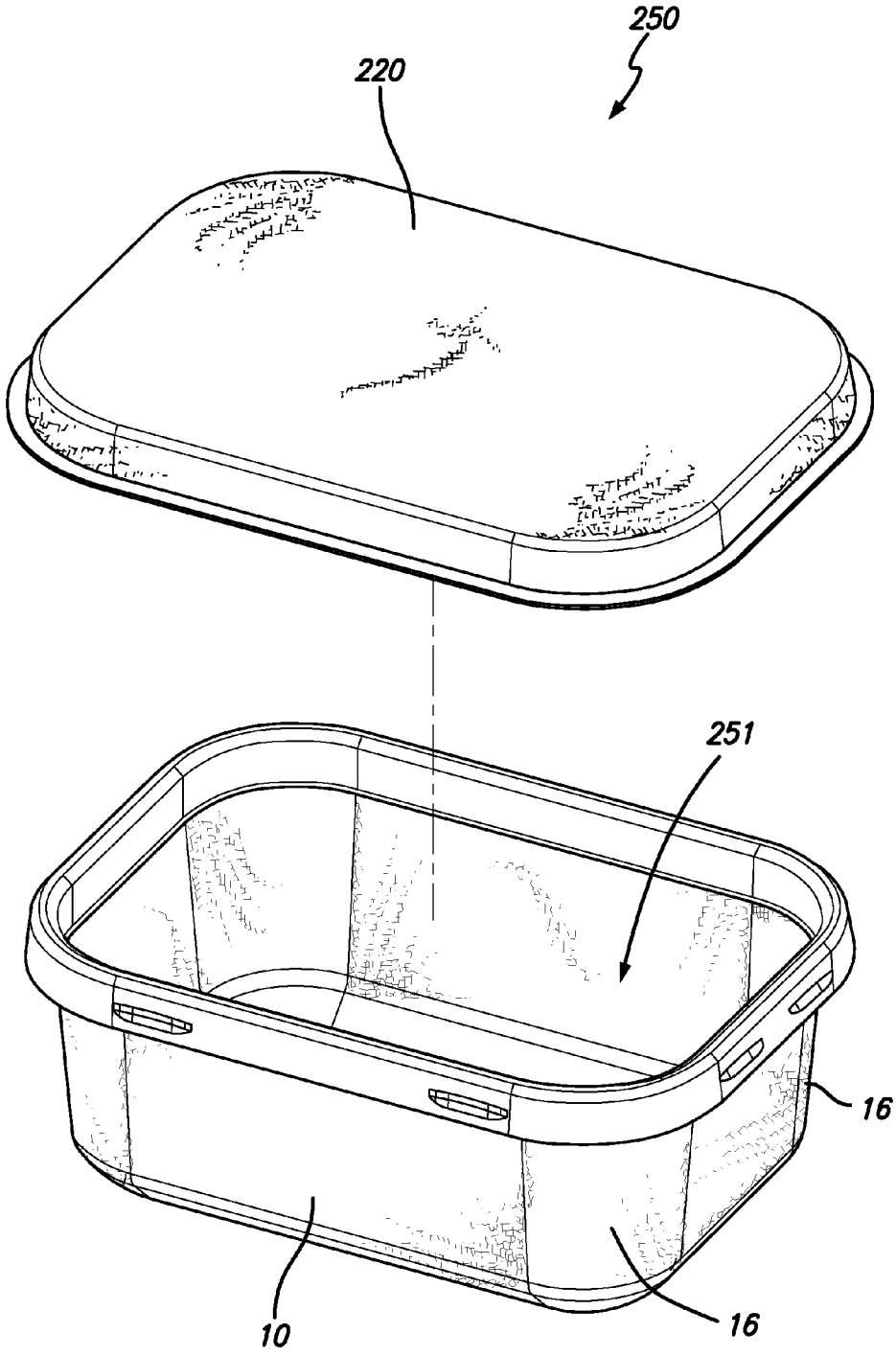
Figure 8C:
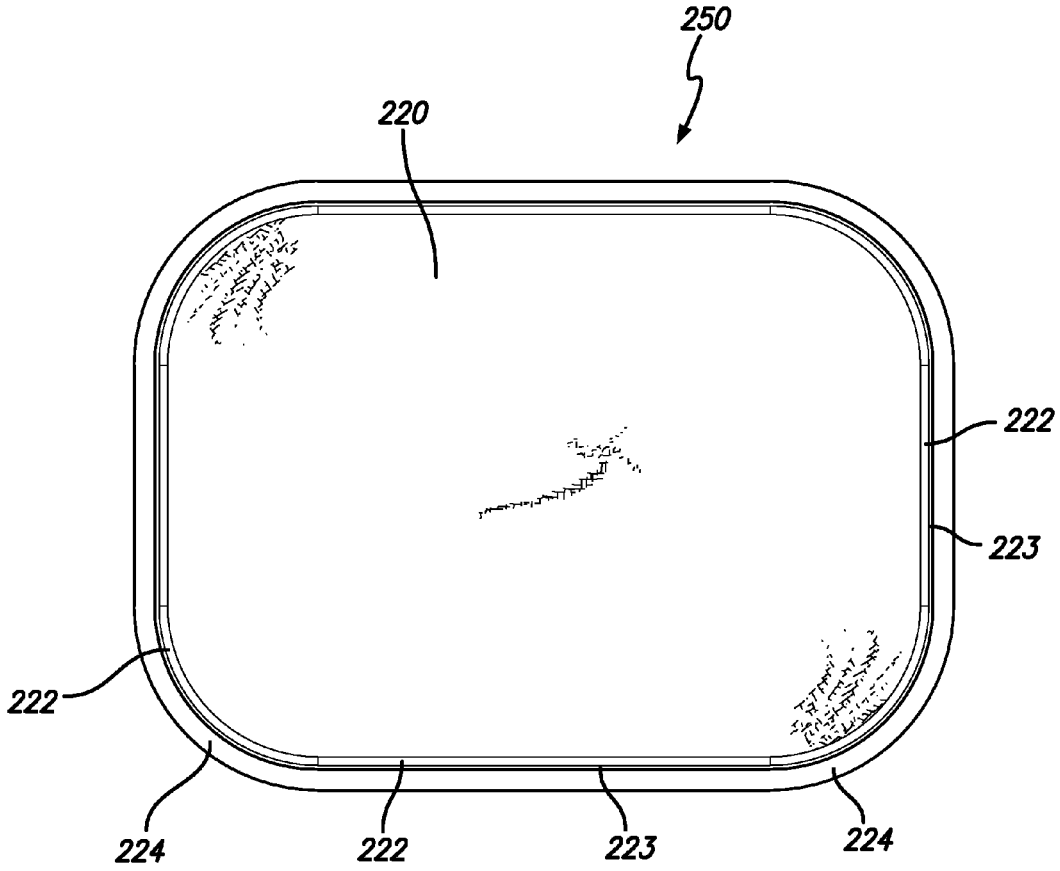
FIGS. 8C, 8D, and 8E are top, first side, and second side views, respectively, of the container of FIG. 8A.
Figure 8D:
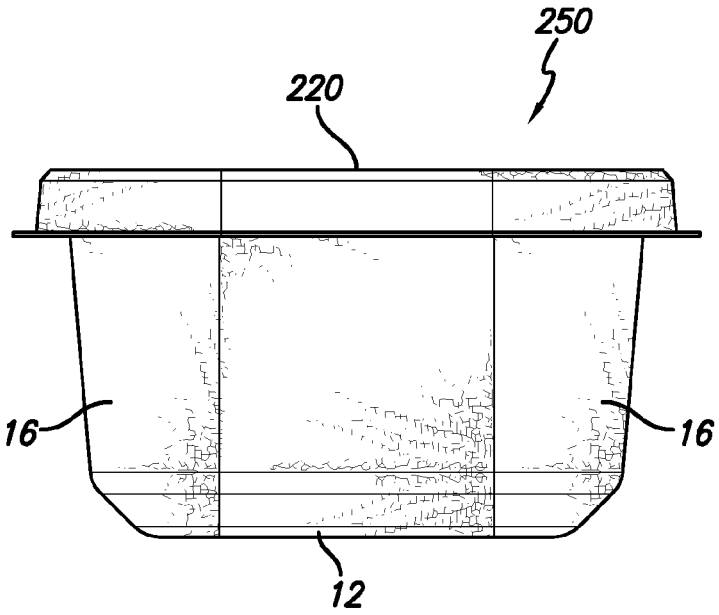
Figure 8E:
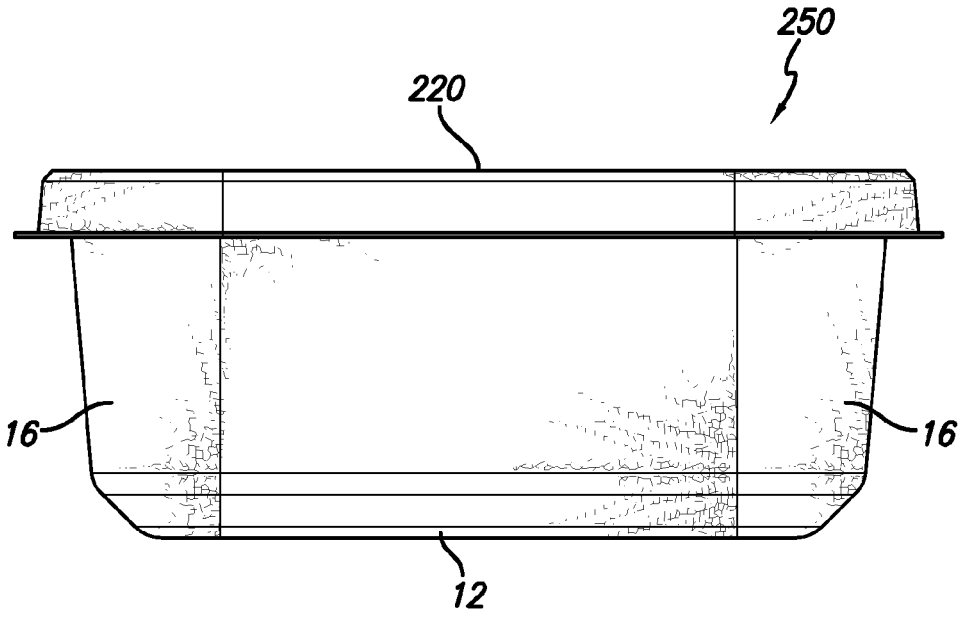
Figure 9A:
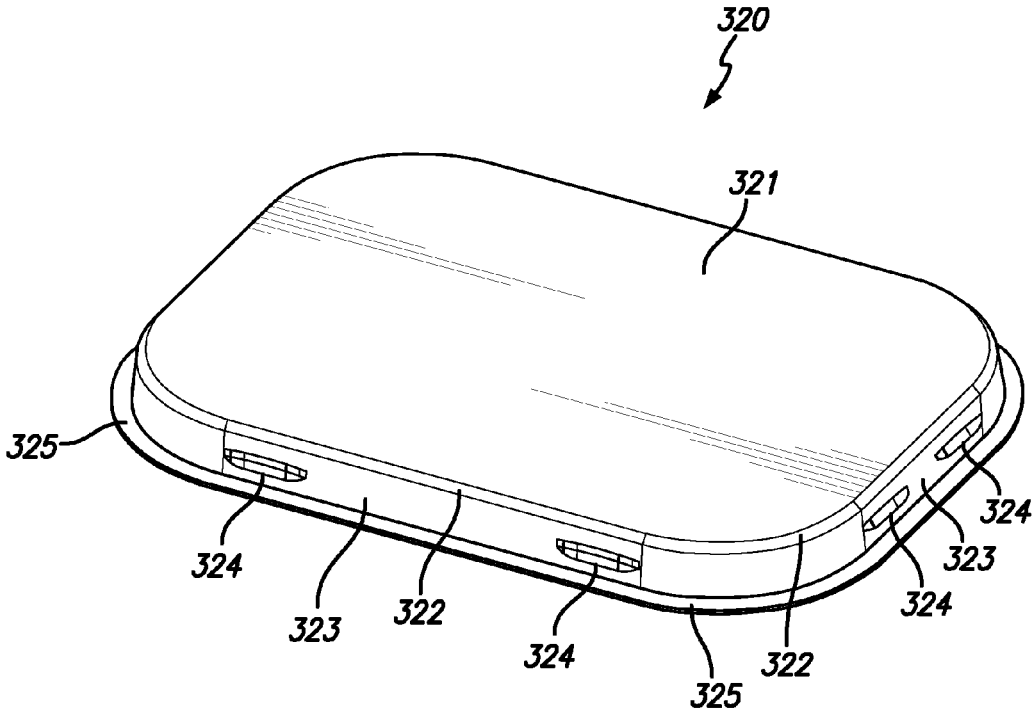
FIGS. 9A, 9B, 9C, and 9D are perspective, top, first side, and second side views, respectively, of a second thermoformed cover for a container according to the invention.
Figure 9B:
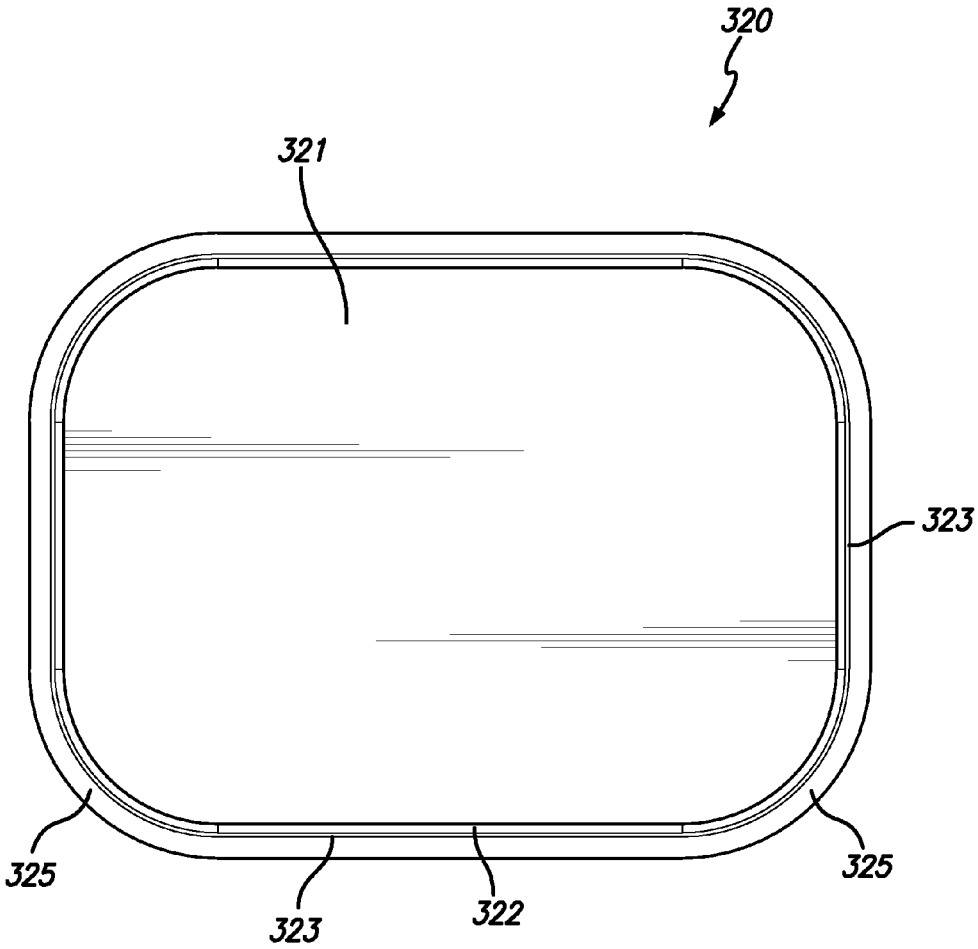
Figure 9C:
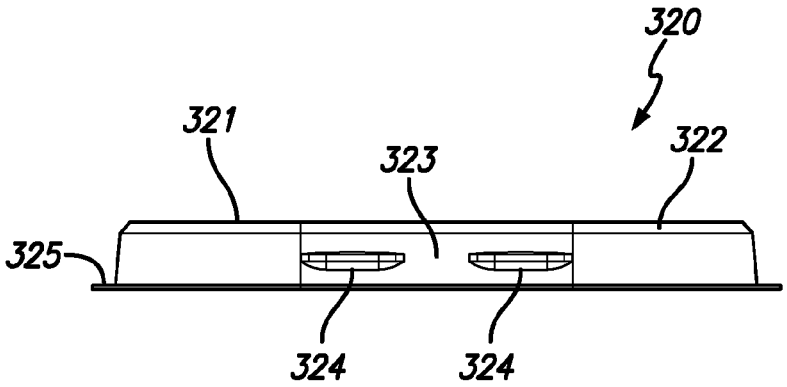
Figure 9D:
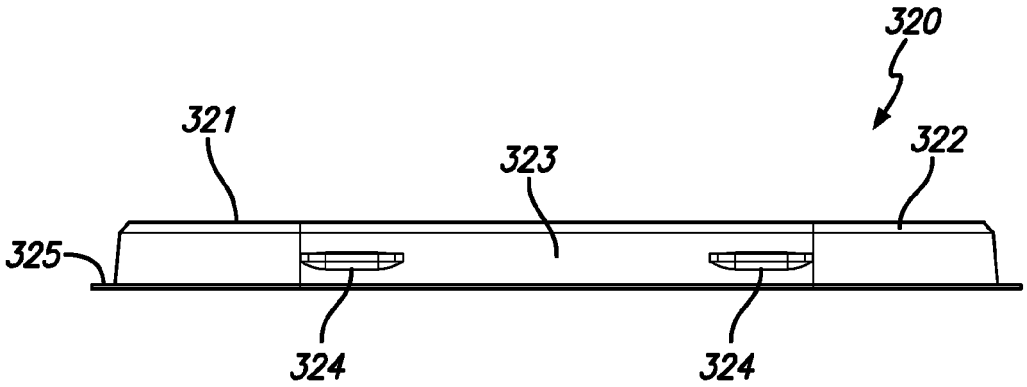

FIGS. 8A and 8B are perspective views of a third hybrid container 250 with a pulp tray 10, a thermoformed collar 110, and a separable pulp cover 220 according to the invention. FIG. 8A shows the pulp cover positioned on the collar 110, thereby forming a third closed compartment 252. FIG. 8B shows the pulp cover 220 separated from the collar 110 to expose the interior of the tray and form a third open compartment 251. FIGS. 8C, 8D, and 8E are top, first side, and second side views, respectively, of the third hybrid container 250 of FIG. 8A.

As perhaps best shown in the cutaway view of FIG. 8A, the third hybrid container 250 is formed by snapping the thermoformed collar 110 onto the pulp tray 10. This is accomplished by engaging the rim 15 of the pulp tray 10 with the rib 113 of the thermoformed collar 110, and pressing the pulp tray 10 into the thermoformed collar 110 so that the ears 18 of the pulp tray 10 snap into position above the protrusions on the thermoformed collar 110. Once the thermoformed collar 110 is in place on the pulp tray 10, the pulp cover 220 can be fitted onto the collar 110.

FIGS. 9A, 9B, 9C, and 9D are perspective, top, first side, and second side views, respectively, of a second thermoformed lid 320 for a container according to the invention. The thermoformed lid 320 has a thermoformed lid central portion 321 extending to thermoformed lid side wall corners 322. Thermoformed lid side walls 323 extend from the thermoformed lid side wall corners 322 to thermoformed lid peripheral flanges 325.

The thermoformed lid side walls 323 include one or more thermoformed lid side walls exterior surface indents that form corresponding bumps or protrusions 324 extending from the interior surface of those side walls 323.

Figure 10A:
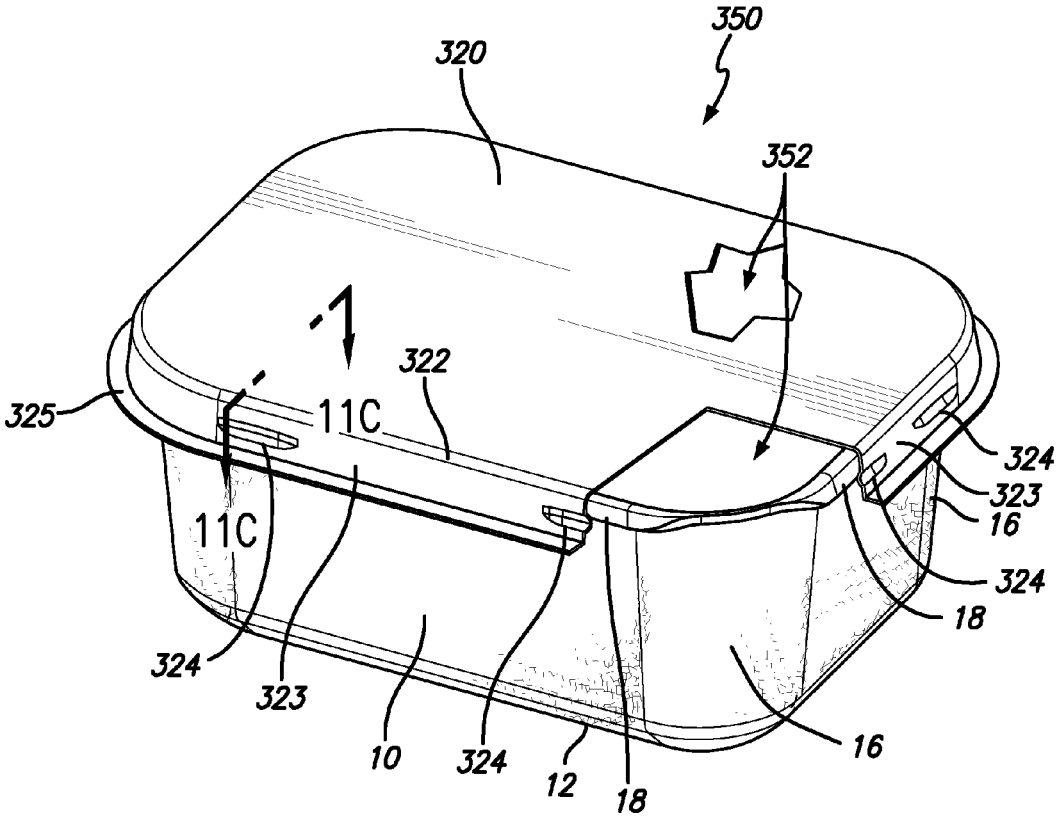
FIGS. 10A and 10B are perspective views of a hybrid container with a pulp tray and a separable thermoformed cover according to the invention, with the thermoformed cover positioned on the pulp tray to form a closed container in FIG. 10A and with the thermoformed cover separated from the pulp tray to expose the interior of the tray in FIG. 10B.
Figure 10B:
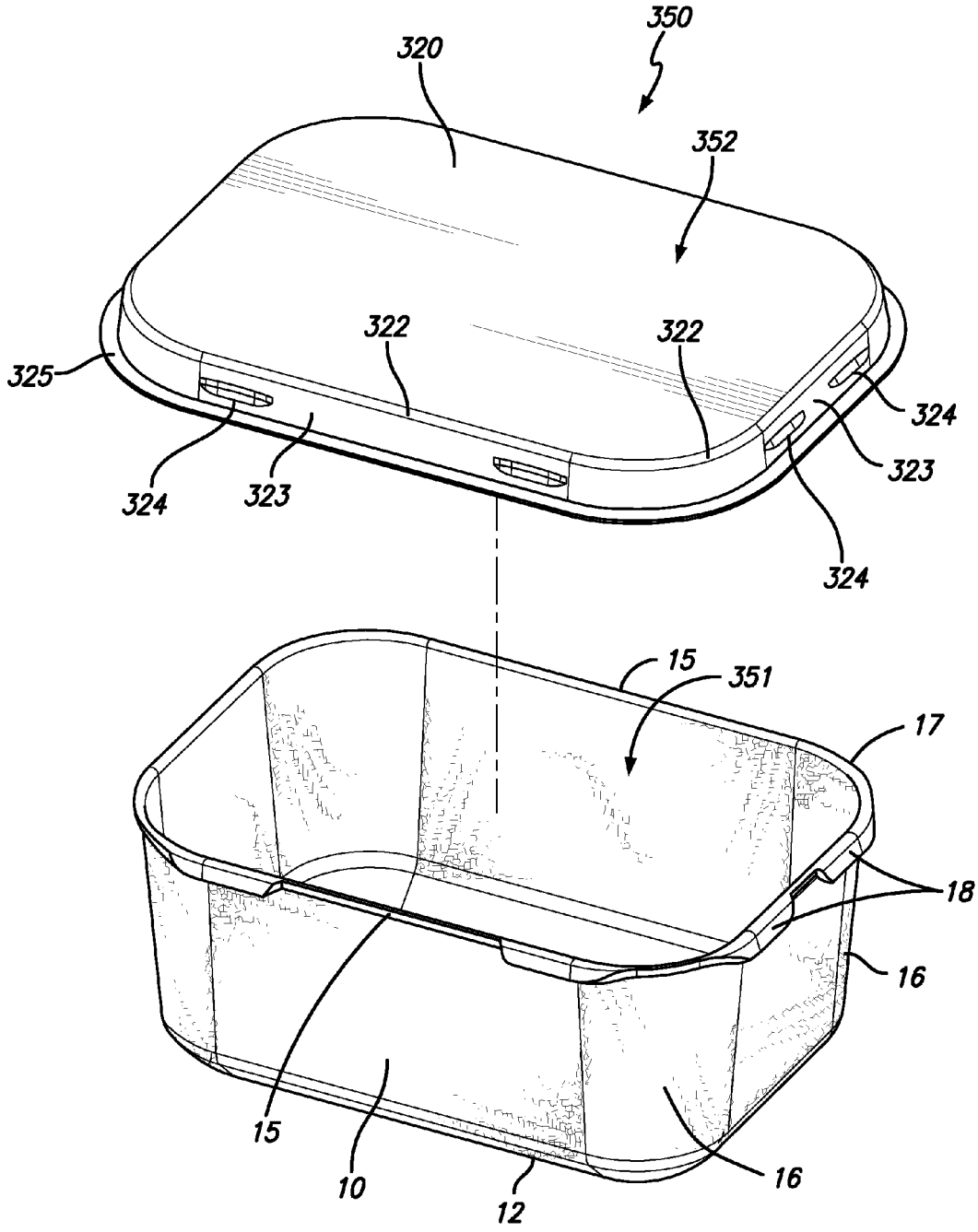
Figure 10C:
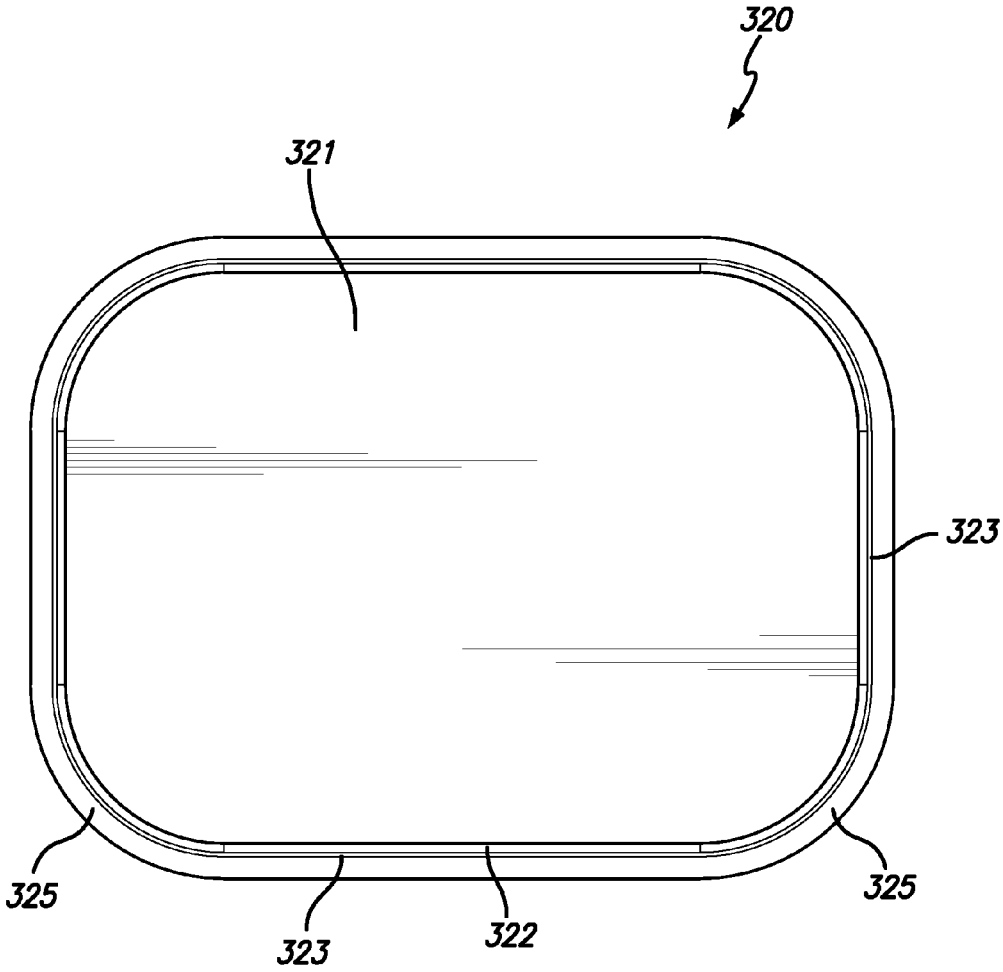
FIGS. 10C, 10D, and 10E are top, first side, and second side views, respectively, of the container of FIG. 10A.
Figure 10D:
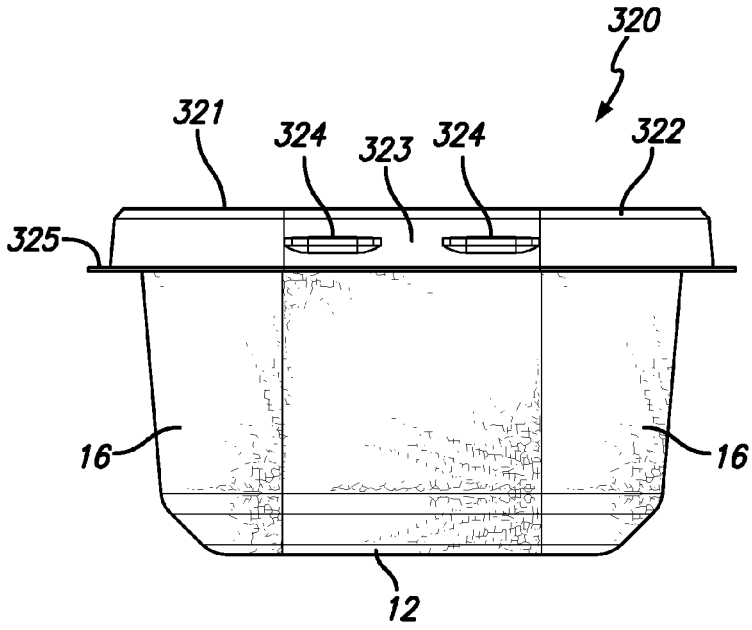
Figure 10E:
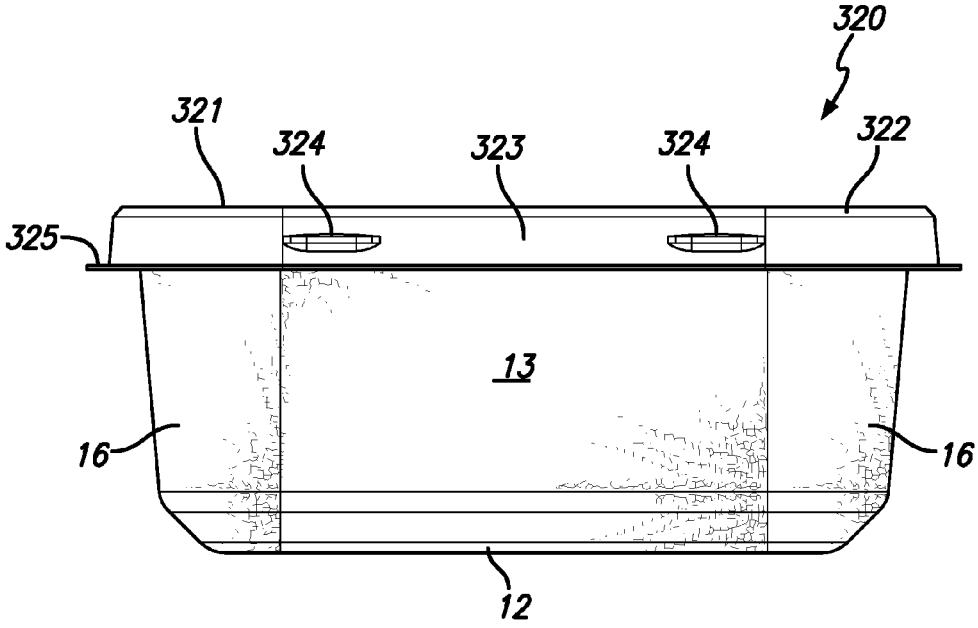

FIGS. 10A and 10B are perspective views of a fourth hybrid container 350 with a pulp tray 10 and a separable second thermoformed lid 320 according to the invention. FIG. 10A shows the second thermoformed lid 320 positioned on the pulp tray 10, thereby forming a third closed compartment 352. FIG. 10 B shows the second thermoformed lid 320 separated from the pulp tray 10 to expose the interior of the tray, thereby forming a third open compartment 351. FIGS. 10C, 10D, and 10E are top, first side, and second side views, respectively, of the fourth hybrid container 350 of FIG. 10A.

As perhaps best shown in the cutaway view of FIG. 10A, the fourth hybrid container 350 is formed by snapping the thermoformed lid 320 onto the pulp tray 10. This is accomplished by engaging the rim 15 of the pulp tray 10 with side walls 323 of the thermoformed lid 320, and pressing the pulp tray 10 into the thermoformed lid 320 so that the ears 18 of the pulp tray 10 snap into position above the protrusions 324 on the thermoformed lid 320.

Figure 11A:
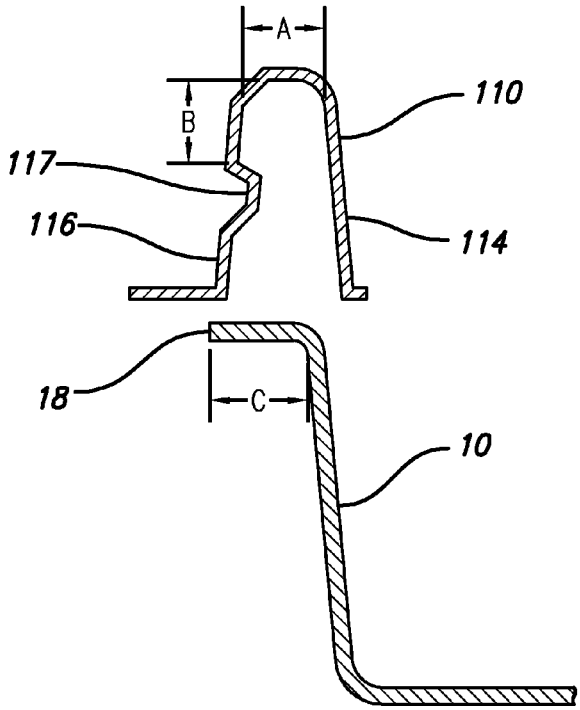
FIG. 11A is a cross-section of the pulp tray 10 and thermoformed collar 110 positioned for engagement.
Figure 11B:
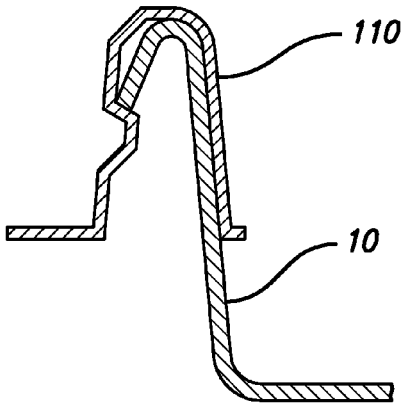
FIG. 11B is a cross section of the container 150 taken along the line 11B-11B in FIG. 6B.
Figure 11C:
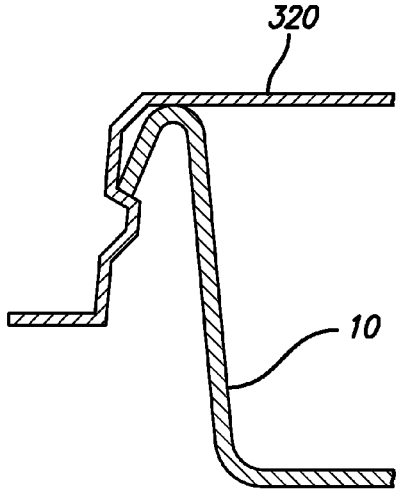
FIG. 11C is a cross section of the container 350 taken along the line 11C-11C in FIG. 10A.

FIG. 11A is a cross-section of the pulp tray 10 and thermoformed collar 110 positioned for engagement, showing the ear or flange portion 18 extending horizontally from the rim of the pulp tray 10. When the tray 10 and thermoformed collar 110 are engaged as shown in FIG. 11B, the ear or flange portion may be bent downward from the rim at a relatively sharp angle to the horizontal. An angle of roughly 60 degrees, or between 45 and 75 degrees, between the cavity side wall 13 and the ear 18 facilitates bearing the vertical forces between the pulp tray 10 and the collar 110, for example if the container is picked up by the collar 110. A similar angle can be used in the container 350 as shown in FIG. 11C. Although the exemplary flange 17 and ear 18 are shown as planar, this is not required and corrugations, die-cut wings that fold perpendicularly to the plane of the flange, or other 3D structures could be used to strengthen and increase the rigidity of the ear 18 or flange 17. While a variety of dimensions could be used, a rib width A of about 0.17 inches, a protrusion-to-peak height B of about 0.17 inches, and an ear or flange width C of about 0.20 inches can be used. In general, the ear or flange width is chosen to be large enough to positively engage the protrusion after insertion into the rib, but small enough to clear the protrusion and snap into place during the insertion process.

While the preceding discussion of exemplary hybrid containers use particular embodiments of a pulp tray 10 and either a thermoformed hinged lid 20, thermoformed collar 110, or thermoformed cover 120, the invention could be practiced with other tray and lid configurations. The exemplary pulp tray 10 includes a single internal cavity 14, but this particular structure is not required. For example, a different number of cavities could be provided for particular applications, and the container as a whole or the individual cavities could be different sizes and/or shapes.

The thermoformed components of a hybrid container according to the invention can be made using conventional thermoforming methods, from any suitable thermoformable material. For example, a thermoformed hinged lid 20, thermoformed collar 110, or thermoformed cover 120 meant for use with ready-to-eat foods might be formed of a thermoformable plastic such as oriented polystyrene (OPS), talc-filled polypropylene (TFPP), polypropylene (PP), high impact polystyrene (HIPS), polyethylene terepthalate (PET), amorphous PET (APET), crystalline polyethylene (CPET) polystyrene copolymer blends, styrene block copolymer blends, and the like.

The pulp components of a hybrid container according to the invention can be made using conventional pulp container manufacturing methods, from any suitable pulp material. As used herein, the term pulp includes at least four industry-standard types of molded fiber products and associated manufacturing methods: (1) thick wall products primarily used for support packaging or plant, floral and nursery pots and containers, (2) transfer molded products commonly used for egg cartons or electronic product packaging, (3) thermoformed or thin-wall products dried in the mold to closely resemble thermoformed plastic material, or (4) processed molded fiber products that require some type of secondary or special treatment other than simply being molded and cured, such as die-cuts, perforations, printing, special slurry formulations, or embossments. However, the pulp components of a hybrid container according to the invention are preferably made using a thermoformed or thin-wall process.

A hybrid container according to the invention may include more than one thermoformed component, and the component or components may be formed of more than one material. Also, the components and materials are not necessarily homogeneous, but may be, for example, a laminate, co-extruded material, or multilayer material.

The exemplary thermoformed hinged lid 20, thermoformed collar 110, and thermoformed lid 320 include specific embodiments of indents that form protrusions able to engage with the ear of a pulp tray. While these exemplary structures show the protrusions at particular locations, this is not required and the protrusions could be located somewhere else.

In the exemplary thermoformed hinged lid 20, thermoformed collar 110, and thermoformed lid 320, the indents on one side of a wall result in protrusions on the other side of the wall shaped as a shelf, rib, or ridge, convex when viewed from the protrusion side that will engage the ear. However, this exact structure is not required and the protrusion could have another male or convex structure such as a post, pin, plug, bulge, bump, hump, pyramid, cube, nub, projection, protrusion, protuberance, knob, or a combination of these structures.

Any of the thermoformed or pulp structures may also include additional special processing, such as one or more raised engravings or embossings for decorative or structural purposes, for example brand markings, informational messages, or decorations.

Additional components could be used in a hybrid container according to the invention. For example a plastic film or foil membrane barrier, sometimes referred to as "lid stock", could be adhered, fastened, joined, thermally bonded, or otherwise positioned on the rim of a pulp tray 10, to the peak of the thermoformed collar 110, or to the peak of the hinged frame rib 36, to cover the contents while allowing an optional thermoformed lid, collar, or cover to be fastened on the pulp tray, collar, or hinged frame. The lid stock can be made of the same r similar material as the lid, or it can be made of a different material. The lid stock may be imprinted, for example with brand names or product information before being applied to the pulp tray. The lid stock can, for example, provide tamper protection or otherwise protect the contents of the pulp tray.

This approach could be used, for example, to provide multiple refills (for wet wipes, baby wipes, food items, or other consumable products) in pulp trays, along with a single reusable thermoformed cover of the types shown in the present application. When the initial pulp tray has been emptied of its contents, a new refill pulp tray can be readied for use by peeling off the membrane barrier then snapping the tray on the thermoformed cover. The combination of a thermoformed collar with a rigid rib structure plus the pulp tray can provide an acceptably rigid structure for this kind of application. In contrast, a package made exclusively of pulp by itself may not be rigid enough to use, and would be more likely to fail during normal use. In this type of application, the hinged lid 20 or thermoformed collar 110 can provide rigidity whether or not the cover is on, and either a thermoformed or a pulp cover can be used with the thermoformed collar 110.

While reusable wet wipes containers with refills are known, the reusable containers are generally formed entirely of plastic, for example as an injected molded tray along with a snap on collar/lid with hinged cover. Because this kind of product is formed entirely of injection molded plastic, a series of undercuts to attach lid to tray can be used.

As an explanation only and not as a limitation on the scope of the claims, it is believed that the present invention arises from the fact that todays' forming methods for double-sided smooth pulp parts typically use two molds, an upper and a lower mold. Liquid bearing pulp material is introduced between the molds, then the liquid is drawn out as the molds are brought together to squeeze or coin the pulp together and form the part. Once the part has been formed, then the upper and lower molds are separated by moving the upper mold linearly relative to the lower mold. The upper and lower molds must be free to move relative to each other in this process, in particular they must be separable linearly. This requirement limits the shapes of the mold, in particular the mold can't include any undercuts and it must have positive draft.

In contrast, undercuts can be fabricated by thermoforming sheet plastic, for example to fabricate the protrusions 35 on the thermoformed hinged lid 20, the protrusions 117 on the thermoformed collar 110, and the protrusions 324 on the thermoformed lid 320. In other words, pulp is different from plastic because today's forming methods for a pulp part can't make undercuts and therefore cannot make indents. A pulp mold can, however, form ears 18 as shown on the pulp tray 10. A hybrid container according to the invention combines a thermoformed part that has indents with a pulp part that has ears for that reason.

It is understood that the invention is not confined to the embodiments set forth herein as illustrative, but embraces all such forms thereof that come within the scope of the following claims.

What is claimed is:

1. A hybrid thermoformed/pulp container comprising:

a molded pulp tray with a rim and a peripheral flange containing a flange portion extending horizontally from the rim; and a thermoformed plastic frame with a rib having an inside wall and an outside wall that define a rib interior region between the inside wall and the outside wall;

wherein the outside wall of the rib includes a protrusion extending into the rib interior region; and wherein the molded pulp tray can be attached to the thermoformed plastic frame by engaging the rim of the molded pulp tray with the rib of the thermoformed plastic frame and snapping the flange portion into position above the protrusion inside the rib interior region with the flange portion bent downward from the rim.

2. The container of claim 1 wherein the flange portion is bent at an angle between 45 and 75 degrees when the thermoformed plastic frame has been snapped into position on the molded pulp tray.

3. The container of claim 2 wherein the flange portion is bent in an arc.

4. The container of claim 2 wherein the flange portion is bent at an angle of about 60 degrees.

5. The container of claim 1 further comprising a membrane barrier fastened to the rim of the molded pulp tray.

6. The container of claim 1 wherein the molded pulp tray includes a cavity, and further comprising a consumer product placed in the cavity.

7. The container of claim 1 wherein the flange includes at least one ear.

8. The container of claim 7 wherein the ear is bent at an angle between 45 and 75 degrees when the thermoformed plastic frame has been snapped into position on the molded pulp tray.

9. The container of claim 8 wherein the ear is bent in an arc.

10. The container of claim 8 wherein the ear is bent at an angle of about 60 degrees.

11. The container of claim 1 further comprising a cover made of thermoformed plastic as a unitary structure with the thermoformed plastic frame and further comprising a hinge joining the cover to the thermoformed plastic frame.

12. A hybrid thermoformed/pulp container kit comprising:

a molded pulp tray with a rim and a peripheral flange that includes at least one ear extending horizontally from the rim; and a thermoformed plastic lid with a side wall with a protrusion extending toward the ear;

wherein the molded pulp tray can be attached to the thermoformed plastic lid by engaging the rim of the molded pulp tray with the side wall of the thermoformed plastic lid and snapping the ear into position above the protrusion; and wherein the ear is bent downward from the rim when the thermoformed lid has been snapped into position on the pulp tray.

13. The kit of claim 12 wherein the ear is bent in an arc.

14. The kit of claim 12 wherein the ear is bent at an angle between 45 and 75 degrees.

15. The kit of claim 12 further comprising a membrane barrier fastened to the rim of the molded pulp tray.

16. The kit of claim 15 of wherein the molded pulp tray includes a cavity, and further comprising a consumer product placed in the cavity.

17. A method of forming a hybrid container comprising the steps of:

(A) providing a molded pulp tray with a rim and a peripheral flange containing a flange portion extending horizontally from the rim;

(B) providing a thermoformed plastic frame with a rib having an inside wall and an outside wall that define a rib interior region between the inside wall and the outside wall, wherein the outside wall of the rib includes a protrusion extending into the rib interior region;

(C) attaching the molded pulp tray to the thermoformed plastic frame by engaging the rim of the molded pulp tray with the rib of the thermoformed plastic frame and snapping the flange portion into position above the protrusion inside the rib interior with the flange portion bent downward from the rim.

18. The method of claim 17 wherein the molded pulp tray includes a cavity, and further comprising the step of filling the cavity with a consumer product.

19. The method of claim 17 further comprising the step of joining a membrane barrier to the rim of the molded pulp tray.

* * * * *